US010947001B2

(12) United States Patent
Taruno

(10) Patent No.: US 10,947,001 B2
(45) Date of Patent: Mar. 16, 2021

(54) DELAMINATABLE CONTAINER

(71) Applicant: KYORAKU CO., LTD., Kyoto (JP)

(72) Inventor: Shinsuke Taruno, Kanagawa (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 16/383,993

(22) Filed: Apr. 15, 2019

(65) Prior Publication Data

US 2019/0256239 A1 Aug. 22, 2019

Related U.S. Application Data

(63) Continuation of application No. 15/100,151, filed as application No. PCT/JP2014/080735 on Nov. 20, 2014, now Pat. No. 10,308,389.

(30) Foreign Application Priority Data

Nov. 27, 2013 (JP) ..... 2013-245358
Nov. 27, 2013 (JP) ..... 2013-245374

(51) Int. Cl.
*B65D 1/02* (2006.01)
*B65D 77/06* (2006.01)
(Continued)

(52) U.S. Cl.
CPC ..... *B65D 1/0215* (2013.01); *B65D 1/023* (2013.01); *B65D 1/0246* (2013.01);
(Continued)

(58) Field of Classification Search
CPC .... B65D 1/0215; B65D 77/06; B65D 90/046; B65D 1/023; B65D 23/02; B65D 77/225
See application file for complete search history.

(56) References Cited

U.S. PATENT DOCUMENTS 2,715,980 A * 8/1955 Frick ..... B65D 49/08 222/183
3,592,365 A 7/1971 Schwartzman
(Continued)

FOREIGN PATENT DOCUMENTS

CN 1323247 A 11/2001
CN 1898073 A 1/2007
(Continued)

OTHER PUBLICATIONS (5th) Japanese Third-Party Preissuance Submissions dated Apr. 22, 2019 in corresponding JP Application No. 2013-245358; 19 pages; Machine translation attached.
(Continued)

*Primary Examiner* — Andrew T Kirsch
(74) *Attorney, Agent, or Firm* — Maier & Maier, PLLC

(57) ABSTRACT

A delaminatable container excellent in productivity is provided. According to an exemplary aspect, a delaminatable container, includes a container body having an outer shell and an inner bag, the inner bag delaminating from the outer shell and being shrunk with a decrease in contents, wherein the container body includes a bottom seal protrusion protruding from a bottom surface of a storage portion to store the contents, and the bottom seal protrusion is a sealing portion of, in blow molding using a cylindrical laminated parison provided with an outer layer constituting the outer shell and an inner layer constituting the inner bag, the laminated parison and is bent.

14 Claims, 21 Drawing Sheets

(51) Int. Cl.

| | |
|---|---|
| ***B65D 23/02*** | (2006.01) |
| ***B65D 77/22*** | (2006.01) |
| ***B65D 41/04*** | (2006.01) |
| ***B65D 85/72*** | (2006.01) |

(52) U.S. Cl.

CPC ..... *B65D 1/0276* (2013.01); *B65D 23/02* (2013.01); *B65D 41/0442* (2013.01); *B65D 77/06* (2013.01); *B65D 77/225* (2013.01); *B65D 85/72* (2013.01)

(56) References Cited

U.S. PATENT DOCUMENTS

| | | | | |
|---|---|---|---|---|
| 4,020,978 | A * | 5/1977 | Szczepanski | B05B 11/046 222/209 |
| 4,026,984 | A | 5/1977 | Seefluth | |
| 4,723,688 | A * | 2/1988 | Munoz | B67D 3/0009 165/140 |
| 5,242,085 | A * | 9/1993 | Richter | B65D 1/0215 215/12.1 |
| 5,332,121 | A * | 7/1994 | Schmidt | B29C 45/1646 222/105 |
| 5,509,738 | A | 4/1996 | Haynes et al. | |
| 5,799,809 | A | 9/1998 | Sako et al. | |
| 5,921,416 | A * | 7/1999 | Uehara | B29C 49/18 215/12.1 |
| 6,223,933 | B1 | 5/2001 | Hochrainer et al. | |
| 6,266,943 | B1 | 7/2001 | Nomoto et al. | |
| 6,276,558 | B1 | 8/2001 | Kneer | |
| 7,017,761 | B1 | 3/2006 | Kneer | |
| 7,090,093 | B2 * | 8/2006 | Hochrainer | B65D 83/0055 220/723 |
| 7,614,515 | B2 | 11/2009 | Furusawa | |
| 2001/0027154 | A1 | 10/2001 | Nomoto et al. | |
| 2004/0112921 | A1 | 6/2004 | Nomoto et al. | |
| 2004/0182867 | A1 | 9/2004 | Hochrainer et al. | |
| 2008/0302757 | A1 | 12/2008 | Furusawa et al. | |
| 2010/0133408 | A1 | 6/2010 | Umezaki et al. | |

FOREIGN PATENT DOCUMENTS

| | | | |
|---|---|---|---|
| JP | 55-29432 | A | 3/1980 |
| JP | S57-41722 | U | 3/1982 |
| JP | H03-032013 | A | 3/1991 |
| JP | H03-32055 | U | 3/1991 |
| JP | H03-87654 | U | 9/1991 |
| JP | H04-38917 | U | 4/1992 |
| JP | H06-345069 | A | 12/1994 |
| JP | H08-156078 | A | 6/1996 |
| JP | 3401519 | A | 8/1996 |
| JP | 3650175 | A | 3/1997 |
| JP | H09-124051 | A | 5/1997 |
| JP | H10-156929 | A | 6/1998 |
| JP | H11-268720 | A | 10/1999 |
| JP | 2001-514133 | A | 9/2001 |
| JP | 2002-002760 | A | 1/2002 |
| JP | 3413507 | B2 | 6/2003 |
| JP | 2004-059077 | A | 2/2004 |
| JP | 2004-149196 | A | 5/2004 |
| JP | 2004-196357 | A | 7/2004 |
| JP | 2005-008266 | A | 1/2005 |
| JP | 3641695 | B2 | 4/2005 |
| JP | 2008-114856 | A | 5/2008 |
| JP | 2008-239225 | A | 10/2008 |
| JP | 2010-126027 | A | 6/2010 |
| JP | 2010-126207 | A | 6/2010 |
| JP | 2011-152950 | A | 8/2011 |
| JP | 4846428 | B2 | 12/2011 |
| JP | 2012-076758 | A | 4/2012 |

OTHER PUBLICATIONS

Chinese Office Action dated Jan. 6, 2020, in connection with corresponding CN Application No. 201910273075.X (13 pgs., including machine-generated English translation).

International Search Report dated Feb. 10, 2015 from corresponding International Patent Application No. PCT/JP2014/080735; 4 pgs.

Supplementary Partial European Search Report dated Nov. 9, 2016, in connection with corresponding EP Application No. 14865799.2 (6 pgs.)

Chinese Office Action dated Aug. 30, 2017, in connection with corresponding CN Application No. 201480064827.7 (10 pgs., including English translation).

Third Party Pre-Issuance Submission (Submission of Publication) dated Nov. 13, 2017, in connection with corresponding JP Application No. 2013-245374 (2 pgs., including English translation).

Third Party Pre-Issuance Submission (Submission of Publication) dated Nov. 27, 2017, in connection with corresponding JP Application No. 2013-245358 (11 pgs., including English translation).

Third Party Pre-Issuance Submission (Submission of Publication) dated Dec. 11, 2017, in connection with corresponding JP Application No. 2013-245358 (12 pgs., including English translation).

Japanese Office Action dated Feb. 2, 2018 in connection with corresponding JP Application No. 2013-245358; 7 pages.

Japanese Office Action dated Feb. 2, 2018 in connection with corresponding JP Application No. 2013-245374; 7 pages.

Third Party Pre-Issuance Submission (Submission of Publication) dated Feb. 9, 2018, in connection with corresponding JP Application No. 2013-245374; 2 pgs.

Japanese Third Party Preissuance Submission dated Apr. 18, 2018, in connection with corresponding JP Application No. 2013-245358 (12 pgs., including English translation).

Office Action dated Jul. 24, 2018 in corresponding Japanese Application No. 2013-245358; 13 pages including English-language translation.

(4th) Japanese 3rd Party Submission dated Sep. 25, 2018, in connection with corresponding JP Application No. 2013-245358 (13 pgs., including English translation).

Office Action dated Mar. 9, 2020 in corresponding Chinese Application No. 201910484463.2; 29 pages including English-language translation.

Japanese Office Action dated Mar. 31, 2020, in connection with corresponding JP Application No. 2013-245358 (6 pp., including machine-generated English-language translation).

* cited by examiner

MULTILAYER PARISON
EVOH
ADHESION
PE
PP
MOLD
PARISON EXTRUSION

BLOWING NOZZLE
MOLD CLOSING, BLOWING

BLOWING NOZZLE
LOWER BURR
MOLD OPENING

RETRIEVAL, ALIGNMENT

33
BLOWING
31
INNER LAYER DELAMINATION
INNER LAYER PRELIMINARY DELAMINATION

BORING TOOL
MAKE CIRCULAR HOLE IN OUTER SHELL
FRESH AIR INLET OPENING

FRESH AIR INLET OPENING, INNER LAYER PRELIMINARY DELAMINATION PROCEDURE

SECOND STAGE FRESH AIR INLET

SET CONTAINER

HEAT CUTTER BLADE

MOVE AT HIGH SPEED IMMEDIATELY IN FRONT OF CONTAINER

PENETRATE AT VERY SLOW SPEED WHILE SUCKING

DISCHARGE BURR BY BLOWING

INNER BAG PRELIMINARY DELAMINATION
SUCTION
BLOWING
X1
X2
1
2
2a
2b
2c
2d
2f
12
14
15
15a
33

SHARP EDGE SHAPE

ROUNDED EDGE SHAPE

PROCEDURE OF HOT AIR BENDING
IN BREAKAGE PREVENTION

PINHOLE CHECK

INSERT VALVE MEMBER
INTO FRESH AIR INLET

CUT UPPER
TUBULAR PORTION

RESTORE INNER
BAG BY BLOWING

FILL CONTENTS

CAPPING

SHRINK WRAP

REPLACEMENT SHEET
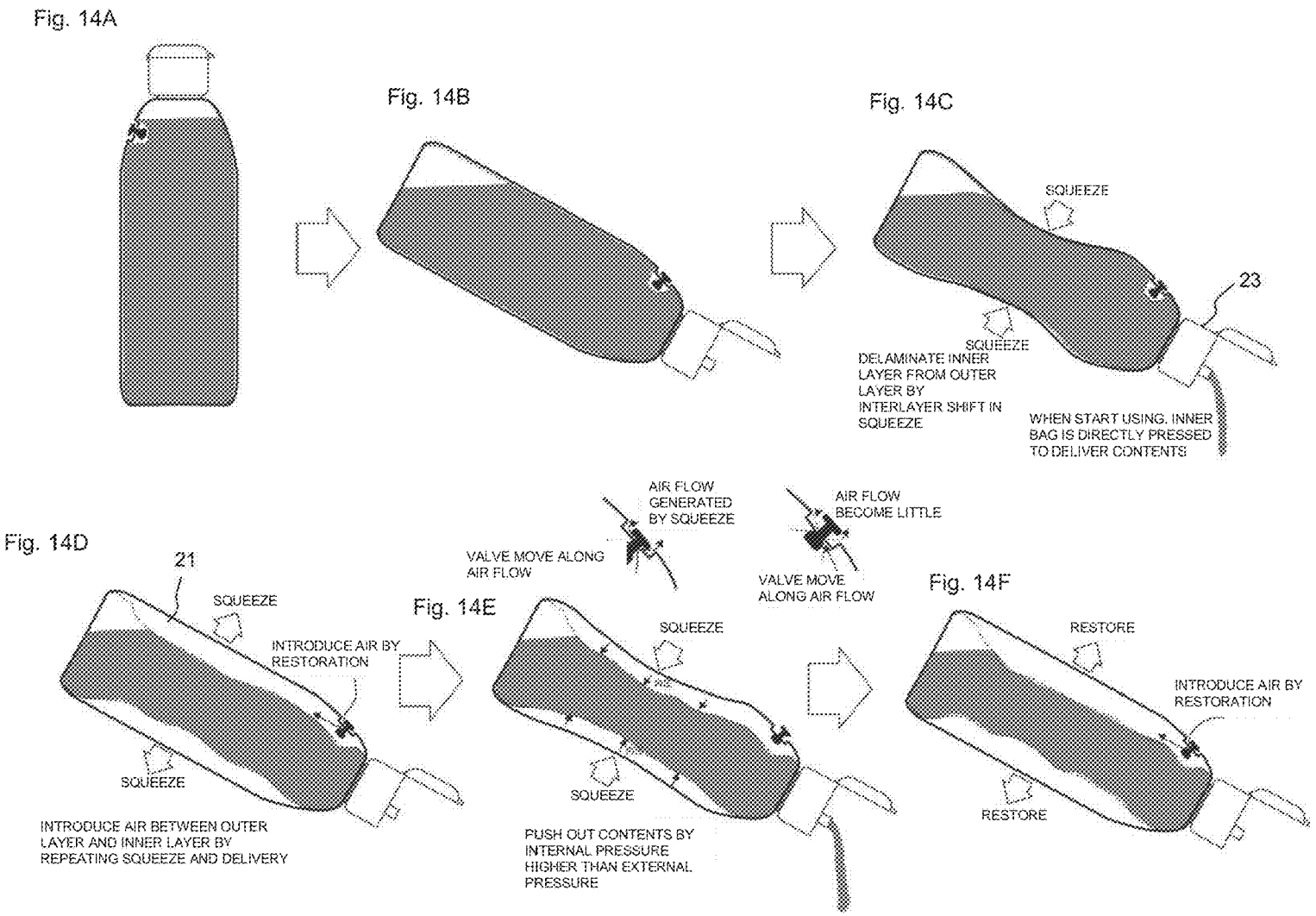

SECOND EMBODIMENT

A-A CROSS-SECTIONAL VIEW

FIRST STRUCTURAL EXAMPLE

SECOND STRUCTURAL EXAMPLE

THIRD STRUCTURAL EXAMPLE

FOURTH STRUCTURAL EXAMPLE

FIFTH STRUCTURAL EXAMPLE

DELAMINATABLE CONTAINER

CROSS-REFERENCE TO RELATED APPLICATIONS

This application is a continuation of U.S. patent application Ser. No. 15/100,151, filed on May 27, 2016, which is the national phase application of International Application No. PCT/JP2014/080735, filed on Nov. 20, 2014, which claims priority to Japanese Application No. 2013-245374, filed on Nov. 27, 2013, and Japanese Application No. 2013-245358, filed on Nov. 27, 2013, the entire contents of which are hereby incorporated by reference.

TECHNICAL FIELD

The present invention relates to a delaminatable container having an inner layer delaminated from an outer layer and shrunk with a decrease in the contents.

BACKGROUND ART

Conventionally, delaminatable containers are known that inhibit entrance of air inside the container by an inner layer delaminated from an outer layer and shrunk with a decrease in the contents (e.g., PTLs 1 and 2). Such delaminatable container is provided with an inner bag composed of the inner layer and an outer shell composed of the outer layer.

A container body of such delaminatable container is generally manufactured by blow molding using a cylindrical laminated parison. The container body has a bottom equipped with a sealing portion when an end of the laminated parison is welded. Since the sealing portion is not resistant to impact, it is provided to protrude from a bottom surface of the container to increase the strength. In PTL 1, to increase the strength of the sealing portion even more, welded layers in the sealing portion are welded to be engaged with each other by a plurality of penetration portions.

CITATION LIST

Patent Literature

[PTL 1] Japanese Patent No. 3401519
[PTL 2] Japanese Patent No. 3650175

SUMMARY OF INVENTION

Technical Problem (First Aspect)

To achieve the composition of PTL 1, a die has to be provided with a pin to press the parison welding layer, resulting in a complex die structure, which increases production costs. It is therefore desired to reinforce the sealing portion with simpler configuration.

A first aspect of the present invention has been made in view of such circumstances, and it is to provide a delaminatable container excellent in productivity.

(Second Aspect)

A delaminatable container is normally used with a cap mounted in a mouth. To prevent leakage of the contents from a gap between the cap and the mouth, a cap provided with an inner ring that closely adheres to an inner surface of the mouth is used.

When the present inventors repeatedly performed an experiment of mounting a cap to a delaminatable container, it is found that the inner ring is caught on the inner layer of the mouth to bend the inner layer, and in the worst case, the inner layer sometimes delaminates completely from the outer layer in the mouth, causing the inner bag to fall out in the outer shell.

A second aspect of the present invention has been made in view of such circumstances, and it is to provide a delaminatable container that inhibits inner layer delamination in a mouth of the delaminatable container.

Solution to Problem (First Aspect)

According to the first aspect of the present invention, a delaminatable container is provided that includes: a container body having an outer shell and an inner bag, the inner bag delaminating from the outer shell and being shrunk with a decrease in contents, wherein the container body includes a bottom seal protrusion protruding from a bottom surface of a storage portion to store the contents, and the bottom seal protrusion is a sealing portion of, in blow molding using a cylindrical laminated parison provided with an outer layer constituting the outer shell and an inner layer constituting the inner bag, the laminated parison and is bent.

Based on intensive examinations, the present inventors found that a sealing portion is reinforced by a simple configuration of bending a bottom seal protrusion protruding from a bottom surface of a storage portion of a container body and thus have come to complete the present invention.

Various embodiments in the first aspect of the present invention are exemplified below. The embodiments described below may be combined with each other.

It is preferred that the bottom seal protrusion includes, in order from a side of the bottom surface, a thinner portion and a thicker portion having a thickness greater than that of the thinner portion.

It is preferred that the bottom seal protrusion is bent in the thinner portion.

It is preferred that the bottom surface includes a concave region and a peripheral region provided surrounding the concave region, and the bottom seal protrusion is provided in the concave region.

It is preferred that the bottom seal protrusion is configured not to protrude from a plane defined by the peripheral region in a state of being bent.

It is preferred that the concave region is provided across the entire bottom surface in a longitudinal direction of the bottom seal protrusion.

According to another aspect, the present invention is a method of manufacturing the above delaminatable container, and it is to provide a method of manufacturing the delaminatable container, that includes bending the bottom seal protrusion by softening by blowing hot air after blow molding.

(Second Aspect)

According to the second aspect of the present invention, a delaminatable container is provided that includes a container body provided with a storage portion to store contents and a mouth to deliver the contents from the storage portion, the storage portion and the mouth having an outer layer and an inner layer, the inner layer delaminating from the outer layer and being shrunk with a decrease in the contents, wherein the mouth includes an enlarged diameter portion provided at an end of the mouth and an inner layer support portion provided in a position closer to the storage portion than the enlarged diameter portion and inhibiting slip down of the inner layer.

According to intensive review by the present inventors, it is found that a conventional delaminatable container has a mouth in an approximately cylindrical shape, and when the mouth has an inner diameter smaller than the outer diameter of the inner ring due to variations in manufacturing and the like, the end of the inner ring sometimes enters between the inner layer and the outer layer at the end of the mouth. Based on such finding, they have come up with the idea of providing an enlarged diameter portion in the end of the mouth and actually produced a delaminatable container having such configuration. The entrance of the inner ring between the inner layer and the outer layer is inhibited and inner layer delamination in the mouth of the delaminatable container is inhibited.

Although this method prevents the phenomenon that the inner bag falls out in the outer shell, a phenomenon possibly occurs that the inner layer delaminates due to friction between the inner layer and the inner ring and the inner bag falls out in the outer shell. To prevent such phenomenon more securely, as a result of further review, they have come up with the idea of providing an inner layer support portion to inhibit slip down of the inner layer in a position closer to the body side than the enlarged diameter portion and thus have come to complete the present invention.

Various embodiments in the second aspect of the present invention are exemplified below. The embodiments described below may be combined with each other.

It is preferred that the storage portion includes a main portion having an approximately constant cross-sectional shape in longitudinal directions of the storage portion and a shoulder portion linking the main portion to the mouth, the shoulder portion or a boundary between the shoulder portion and the main portion includes a bent portion, and the bent portion has a bending angle of 140 degrees or less and has a radius of curvature of 4 mm or less on a side of a container inner surface in the bent portion.

It is preferred that the bending angle is120 degrees or less.

It is preferred that the radius of curvature is 2 mm or less.

It is preferred that the bent portion is provided in a position where a distance from a container center axis to the container inner surface in the bent portion is 1.3 times or more of a distance from the container center axis to the container inner surface in the mouth.

It is preferred that the mouth has a thickness from 0.45 to 0.50 mm, the bent portion has a thickness from 0.25 to 0.30 mm, and the main portion has a thickness from 0.15 to 0.20 mm.

Among the Examples described later, a first experimental example relates to a shape of a valve member, a second experimental example relates to a shape of a mounting portion of a valve member, a third experimental example relates to effects of using a random copolymer for the outer layer, and a fourth experimental example relates to effects of making an innermost layer of an inner layer as an EVOH layer. The third experimental example relates to the first aspect of the present invention and the fourth experimental example relates to the second aspect of the present invention.

BRIEF DESCRIPTION OF DRAWINGS

FIG. 1A illustrates an overall view, FIG. 1B illustrates the bottom, and FIG. 1C illustrates an enlarged view of and around a valve member mounting recess 7*a*. FIG. 1C illustrates a state of removing a valve member 5.

FIG. 2A is a front view, FIG. 2B is a rear view, FIG. 2C is a plan view, and FIG. 1D is a bottom view.

FIG. 3 illustrates a state after bending the bottom seal protrusion 27.

FIG. 6A illustrates a state before bending the bottom seal protrusion 27 and FIG. 6B illustrates a state after bending the bottom seal protrusion 27.

FIG. 12A illustrates the shape of a sharp edge and FIG. 12B illustrates the shape of a rounded edge.

FIGS. 14A through 14F illustrate a method of using the delaminatable container 1 in FIGS. 1A through 1C.

FIG. 15A is a perspective view, FIG. 15B is an enlarged view of and around a valve member mounting recess 7*a*, and FIG. 15C is an A-A cross-sectional view in FIG. 15B. FIGS. 15B and 15C illustrate a state of removing a valve member 5.

FIG. 16A is a perspective view and FIG. 16B is a front view.

FIG. 17A is a perspective view and FIG. 17B is a front view.

FIG. 18A is a perspective view and FIG. 18B is a front view.

FIG. 19A is a perspective view and FIG. 19B is a front view.

FIG. 20A is a perspective view, FIG. 20B is a front view, and FIG. 20C is a perspective view taken from the bottom surface side.

FIGS. 20A and 20B are perspective views of the valve member 5, FIG. 20C is a front view of the valve member 5, and FIGS. 20D through 20E are front views a state of mounting the valve member 5 in a fresh air inlet 15 (an outer shell 12 is shown in a cross-sectional view).

DESCRIPTION OF EMBODIMENTS

Figure 1A:
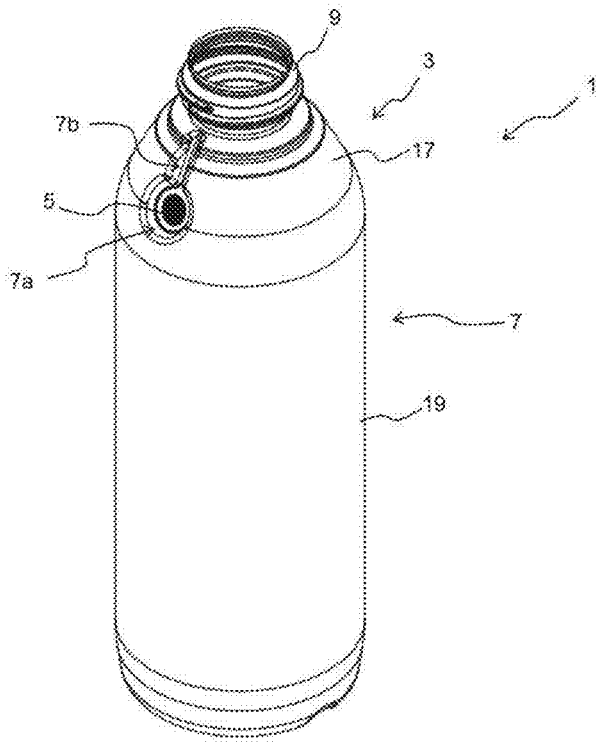
FIGS. 1A through 1C are perspective views illustrating a structure of a delaminatable container 1 in a first embodiment of the present invention, where

Embodiments of the present invention are described below. Various characteristics in the embodiments described below may be combined with each other. Each characteristic is independently inventive.

1. First Embodiment

As illustrated in FIGS. 1A through 2D, a delaminatable container 1 in the first embodiment of the present invention is provided with a container body 3 and a valve member 5. The container body 3 is provided with a storage portion 7 to store the contents and a mouth 9 to deliver the contents from the storage portion 7.

Figure 3:
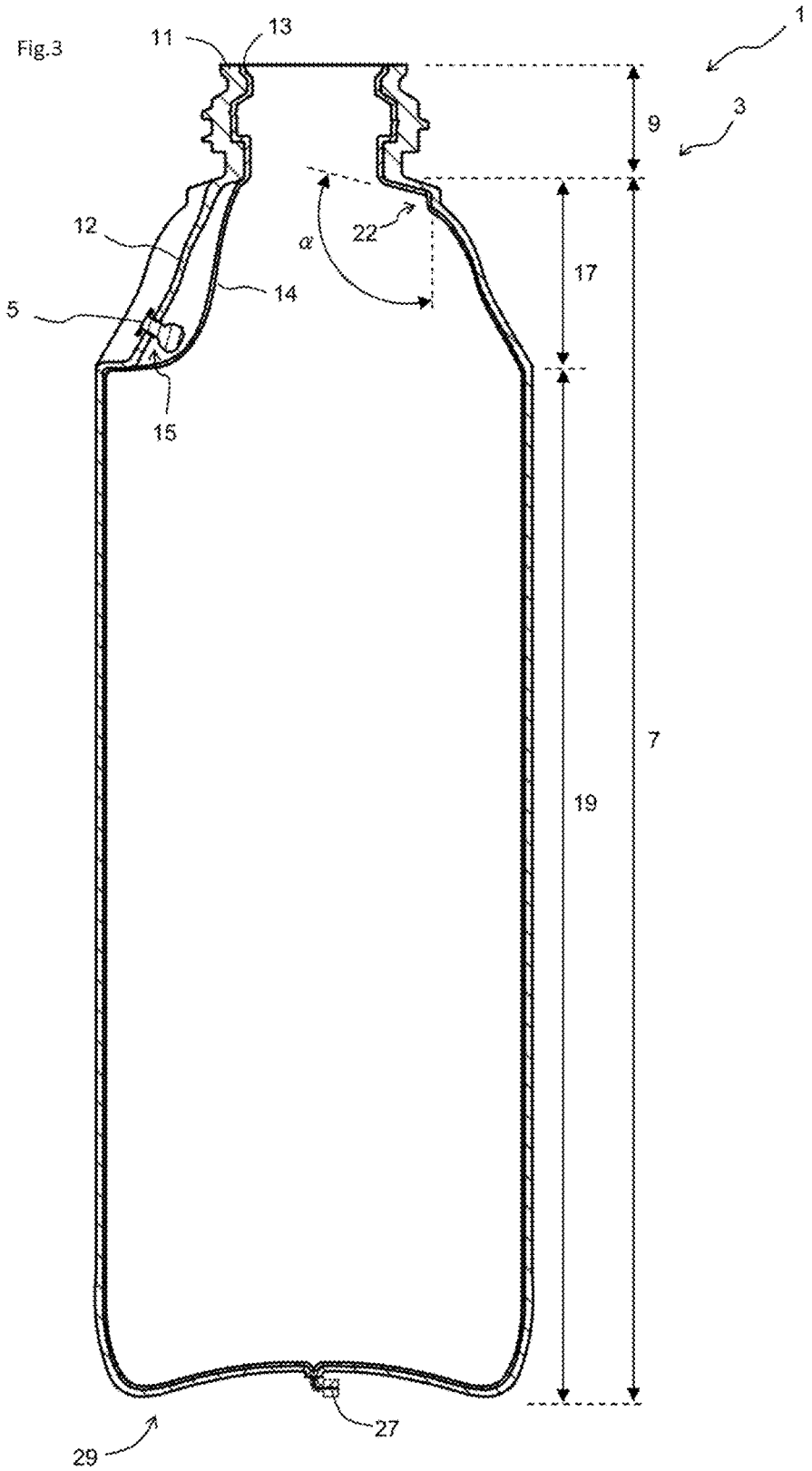
FIG. 3 is an A-A cross-sectional view in FIG. 2D. Note that FIGS. 1A through 2D illustrate states before bending a bottom seal protrusion 27

As illustrated in FIG. 3, the container body 3 is provided with an outer layer 11 and an inner layer 13 in the storage portion 7 and the mouth 9. An outer shell 12 is composed of the outer layer 11 and an inner bag 14 is composed of the inner layer 13. Due to delamination of the inner layer 13 from the outer layer 11 with a decrease in the contents, the inner bag 14 delaminates from the outer shell 12 to be shrunk.

Figure 4:
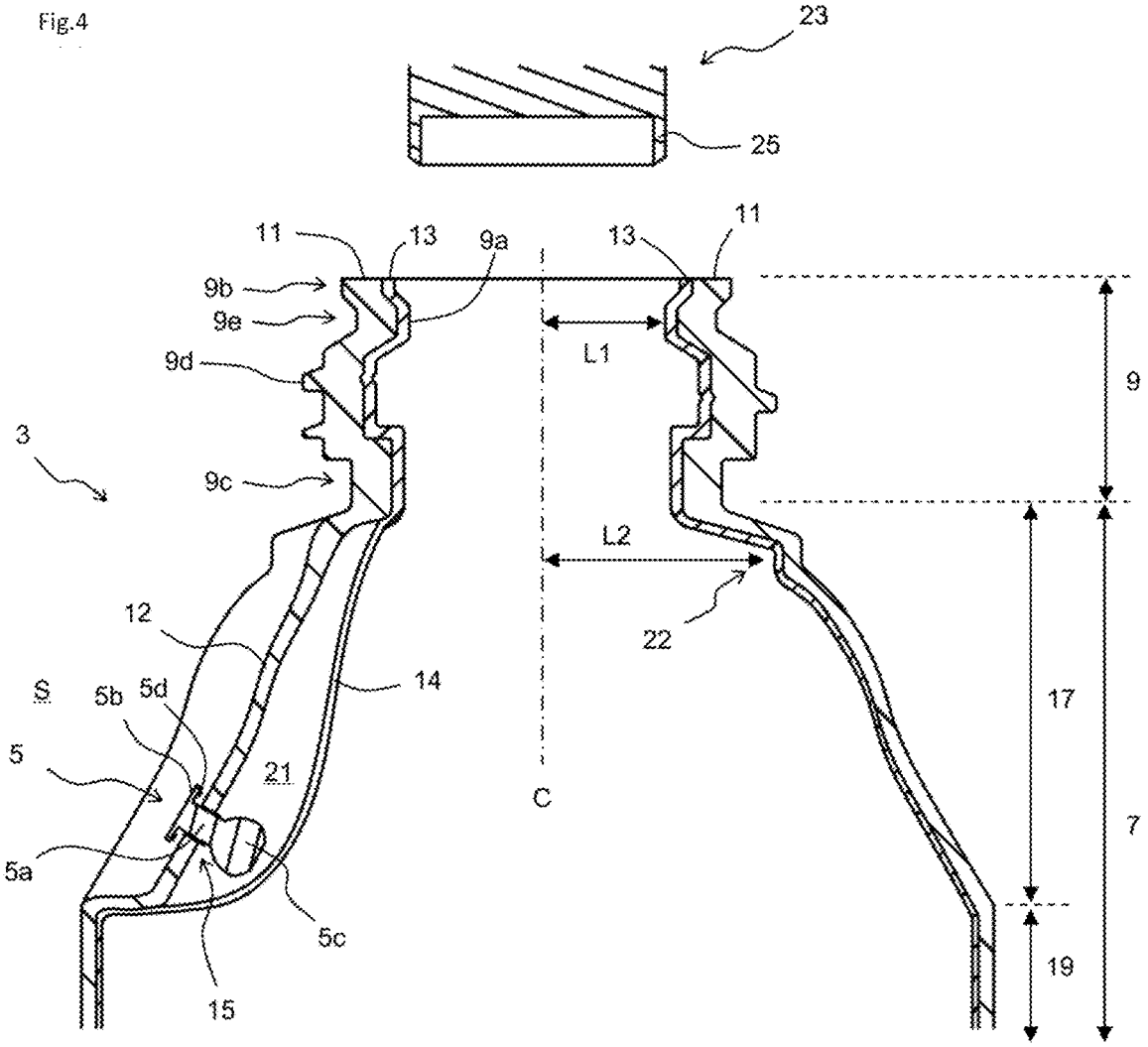
FIG. 4 is an enlarged view of a region including a mouth 9 in FIG. 3.

As illustrated in FIG. 4, the mouth 9 is equipped with external threads 9*d*. To the external threads 9*d*, a cap, a pump, or the like having internal threads is mounted. FIG. 4 partially illustrates a cap 23 having an inner ring 25. The inner ring 25 has an outer diameter approximately same as an inner diameter of the mouth 9. An outer surface of the inner ring 25 abuts on an abutment surface 9*a* of the mouth 9, thereby preventing leakage of the contents. In the present embodiment, the mouth 9 is equipped with an enlarged diameter portion 9*b* at the end. The enlarged diameter portion 9*b* has an inner diameter greater than the inner diameter in an abutment portion 9*e*, and thus the outer surface of the inner ring 25 does not make contact with the enlarged diameter portion 9*b*. When the mouth 9 does not have the enlarged diameter portion 9*b*, a defect sometimes occurs in which the inner ring 25 enters between the outer layer 11 and the inner layer 13 in the case where the mouth 9 has an even slightly smaller inner diameter due to variations in manufacturing. In contrast, when the mouth 9 has the enlarged diameter portion 9*b*, such defect does not occur even in the case where the mouth 9 has a slightly varied inner diameter.

The mouth 9 is also provided with an inner layer support portion 9*c* to inhibit slip down of the inner layer 13 in a position closer to the storage portion 7 than the abutment portion 9*e*. The inner layer support portion 9*c* is formed by providing a narrow part in the mouth 9. Even when the mouth 9 is equipped with the enlarged diameter portion 9*b*, the inner layer 13 sometimes delaminates from the outer layer 11 due to friction between the inner ring 25 and the inner layer 13. In the present embodiment, even in such case, the inner layer support portion 9*c* inhibits slip down of the inner layer 13, and thus it is possible to inhibit falling out of the inner bag 14 in the outer shell 12.

Figure 5:
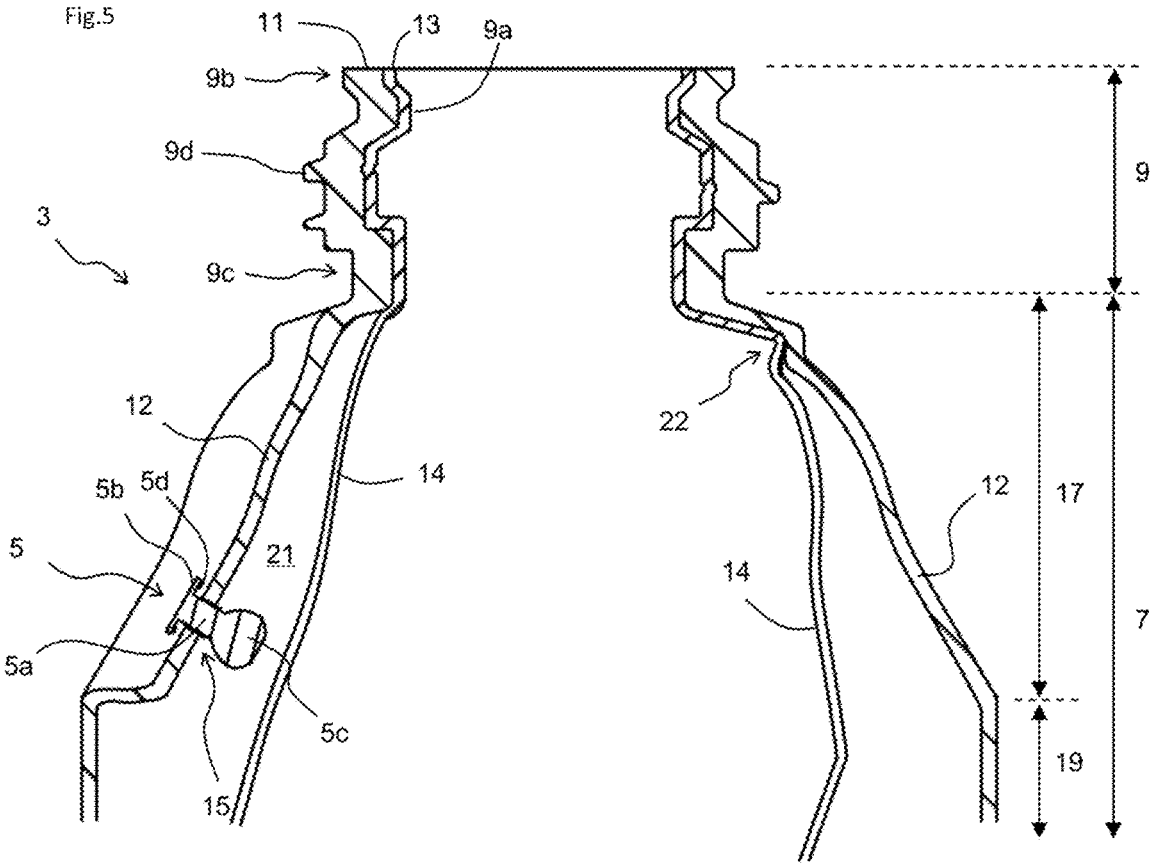
FIG. 5 illustrates a state where delamination of an inner layer 13 proceeds from the state in FIG. 4.

As illustrated in FIGS. 3 through 5, the storage portion 7 is provided with a main portion 19 having an approximately constant cross-sectional shape in longitudinal directions of the storage portion and a shoulder portion 17 linking the main portion 19 to the mouth 9. The shoulder portion 17 is equipped with a bent portion 22. The bent portion 22 is an area with a bending angle α illustrated in FIG. 3 of 140 degrees or less and having a radius of curvature on a container inner surface side of 4 mm or less. Without the bent portion 22, the delamination between the inner layer 13 and the outer layer 11 sometimes extends from the main portion 19 to the mouth 9 to delaminate the inner layer 13 from the outer layer 11 even in the mouth 9. The delamination of the inner layer 13 from the outer layer 11 in the mouth 9 is, however, undesirable because the delamination of the inner layer 13 from the outer layer 11 in the mouth 9 causes falling out of the inner bag 14 in the outer shell 12. Since the bent portion 22 is provided in the present embodiment, even when delamination between the inner layer 13 and the outer layer 11 extends from the main portion 19 to the bent portion 22, the inner layer 13 is bent at the bent portion 22 as illustrated in FIG. 5 and the force to delaminate the inner layer 13 from the outer layer 11 is not transmitted to the area above the bent portion 22. As a result, the delamination between the inner layer 13 and the outer layer 11 in the area above the bent portion 22 is inhibited. Although, in FIGS. 3 through 5, the bent portion 22 is provided in the shoulder portion 17, the bent portion 22 may be provided at the boundary between the shoulder portion 17 and the main portion 19.

Although the lower limit of bending angle α is not particularly defined, it is preferably 90 degrees or more for ease of manufacture. Although the lower limit of the radius of curvature is not particularly defined, it is preferably 0.2 mm or more for ease of manufacture. In order to prevent delamination of the inner layer 13 from the outer layer 11 in the mouth 9 more securely, the bending angle α is preferably 120 degrees or less and the radius of curvature is preferably 2 mm or less. Specifically, the bending angle α is, for example, 90, 95, 100, 105, 110, 115, 120, 125, 130, 135, and 140 degrees or it may be in a range between any two values exemplified here. Specifically, the radius of curvature is, for example, 0.2, 0.4, 0.6, 0.8, 1, 1.2, 1.4, 1.6, 1.8, and 2 mm or it may be in a range between any two values exemplified here.

As illustrated in FIG. 4, the bent portion 22 is provided in a position where a distance L2 from a container center axis C to the container inner surface in the bent portion 22 is 1.3 times or more of a distance L1 from the container center axis C to the container inner surface in the mouth 9. The delaminatable container 1 in the present embodiment is formed by blow molding. The larger L2/L1 causes a larger blow ratio in the bent portion 22, which results in a thinner thickness. When L2/L1≥1.3, the thickness of the inner layer 13 in the bent portion 22 thus becomes sufficiently thin and the inner layer 13 is easily bent at the bent portion 22 to more securely inhibit delamination of the inner layer 13 from the outer layer 11 in the mouth 9. L2/L1 is, for example, from 1.3 to 3 and preferably from 1.4 to 2. Specifically, L2/L1 is, for example, 1.3, 1.4, 1.5, 1.6, 1.7, 1.8, 1.9, 2, 2.5, and 3 or it may be in a range between any two values exemplified here.

To give an example, the thickness in the mouth 9 is from 0.45 to 0.50 mm, the thickness in the bent portion 22 is from 0.25 to 0.30 mm, and the thickness of the main portion 19 is from 0.15 to 0.20 mm. The thickness in the bent portion 22 is thus sufficiently less than the thickness in the mouth 9, thereby effectively exhibiting functions of the bent portion 22.

As illustrated in FIG. 4, the storage portion 7 is equipped with the valve member 5 to regulate entrance and exit of air between an external space S of the container body 3 and an intermediate space 21 between the outer shell 12 and the inner bag 14. The outer shell 12 is equipped with a fresh air inlet 15 communicating with the intermediate space 21 and the external space S in the storage portion 7. The fresh air inlet 15 is a through hole provided only in the outer shell 12 and does not reach the inner bag 14. The valve member 5 is provided with an axis 5*a* inserted into the fresh air inlet 15, a lid 5*c* provided on the intermediate space 21 side of the axis 5*a* and having a cross-sectional area greater than that of the axis 5*a*, and a locking portion 5*b* provided on the external space S side of the axis 5*a* and preventing entrance of the valve member 5 to the intermediate space 21. In the present embodiment, the axis 5*a* is capable of sliding movement relative to the fresh air inlet 15.

The lid 5*c* is configured to substantially close the fresh air inlet 15 when the outer shell 12 is compressed and shaped to have a smaller cross-sectional area as coming closer to the axis 5*a*. The locking portion 5*b* is configured to be capable of introducing air in the intermediate space 21 when the outer shell 12 is restored after compression. When the outer shell 12 is compressed, the pressure in the intermediate space 21 becomes higher than external pressure and the air in the intermediate space 21 leaks outside from the fresh air inlet 15. The pressure difference and the air flow cause the lid 5*c* to move toward the fresh air inlet 15 to close the fresh air inlet 15 by the lid 5*c*. Since the lid 5*c* has a shape with a smaller cross-sectional area as coming closer to the axis 5*a*, the lid 5*c* readily fits into the fresh air inlet 15 to close the fresh air inlet 15.

When the outer shell 12 is further compressed in this state, the pressure in the intermediate space 21 is increased, and as a result, the inner bag is compressed to deliver the contents in the inner bag 14. When the compressive force to the outer shell 12 is released, the outer shell 12 attempts to restore its shape by the elasticity of its own. At this point, the lid 5*c* is separated from the fresh air inlet 15 and the closure of the fresh air inlet 15 is released to introduce fresh air in the intermediate space 21. Not to cause the locking portion 5*b* to close the fresh air inlet 15, the locking portion 5*b* is equipped with projections 5*d* in a portion abutting on the outer shell 12. The projections 5*d* abut on the outer shell 12 to provide gaps between the outer shell 12 and the locking portion 5*b*. Instead of providing the projections 5*d*, closure of the fresh air inlet 15 by the locking portion 5*b* may be prevented by providing grooves in the locking portion 5*b*. FIG. 8 and FIGS. 16A through 20C illustrate specific examples of the structure of the valve member 5.

The valve member 5 is mounted to the container body 3 by inserting the lid 5*c* into the intermediate space 21 while the lid 5*c* presses and expands the fresh air inlet 15. The lid 5*c*, therefore, preferably has an end in a tapered shape. Since such valve member 5 can be mounted only by pressing the lid 5*c* from outside the container body 3 into the intermediate space 21, it is excellent in productivity.

After the valve member 5 is mounted, the storage portion 7 is covered with a shrink film. At this point, not to allow the valve member 5 to interfere with the shrink film, the valve member 5 is mounted to a valve member mounting recess 7*a* provided in the storage portion 7. Not to seal the valve member mounting recess 7*a* with the shrink film, an air circulation groove 7*b* extending from the valve member mounting recess 7*a* in the direction of the mouth 9 is provided.

The valve member mounting recess 7*a* is provided in the shoulder portion 17 of the outer shell 12. The shoulder portion 17 is an inclined surface, and a flat region FR is provided in the valve member mounting recess 7*a*. Since the flat region FR is provided approximately in parallel with the inclined surface of the shoulder portion 17, the flat region FR is also an inclined surface. Since the fresh air inlet 15 is provided in the flat region FR in the valve member mounting recess 7*a*, the fresh air inlet 15 is provided in the inclined surface. When the fresh air inlet 15 is provided in, for example, a vertical surface of the main portion 19, there is a risk that the once delaminated inner bag 14 makes contact with the valve member 5 to interfere with movement of the valve member 5. In the present embodiment, since the fresh air inlet 15 is provided in the inclined surface, there is no such risk and smooth movement of the valve member 5 is secured. Although not particularly limited, an inclination angle of the inclined surface is preferably from 45 to 89 degrees, more preferably from 55 to 85 degrees, and even more preferably from 60 to 80 degrees.

Figure 1B:
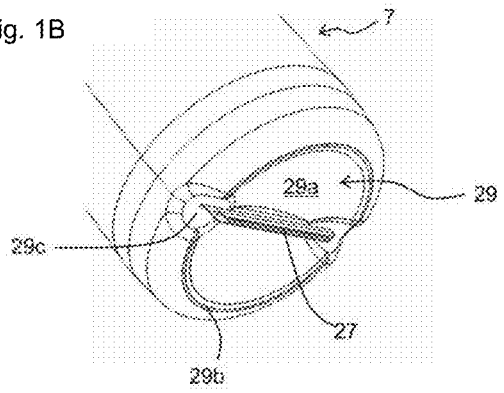
Figure 1C:
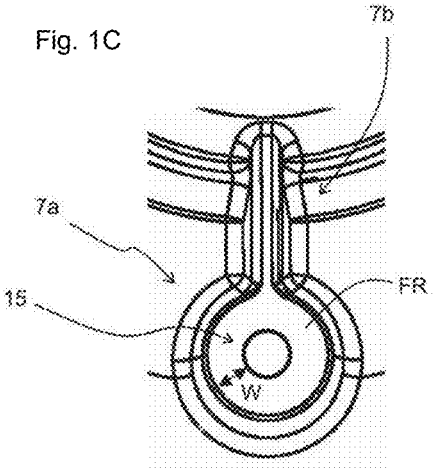
Figure 2C:
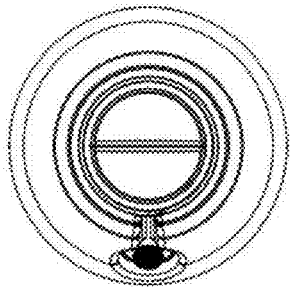
FIGS. 2A through 2D illustrate the delaminatable container 1 in FIGS. 1A through 1C, where
Figure 2A:
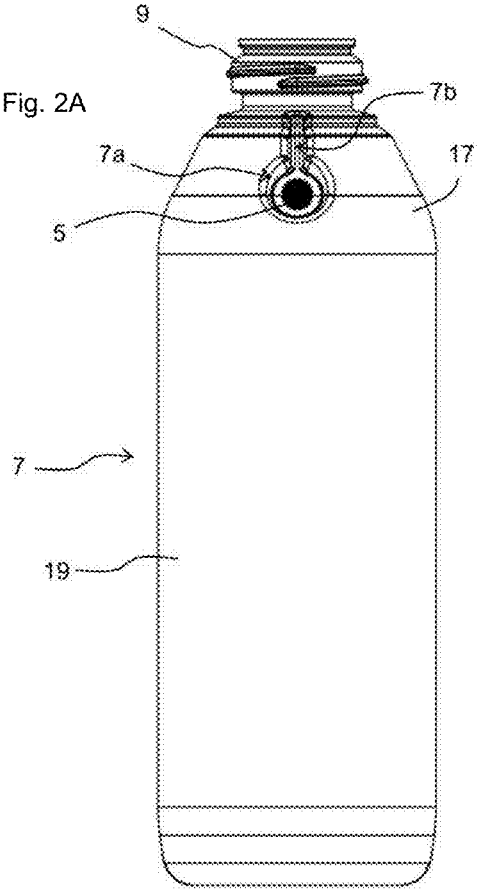
Figure 2B:
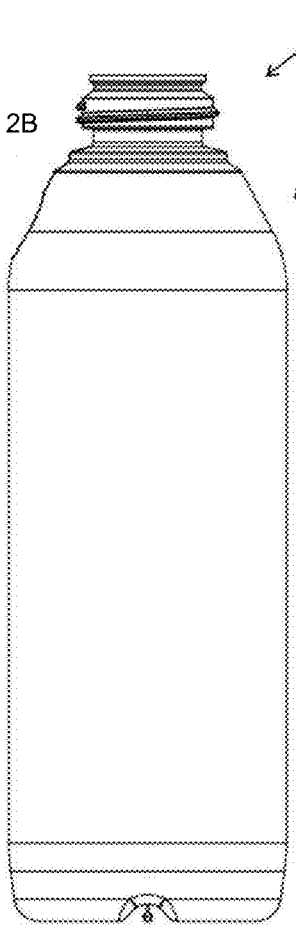
Figure 2D:
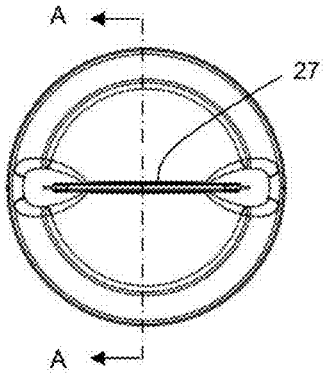

As illustrated in FIG. 1C, the flat region FR in the valve member mounting recess 7*a* is provided across a width W of 3 mm or more (preferably 3.5 mm, 4 mm, or more) surrounding the fresh air inlet 15. For example, when the fresh air inlet 15 is ϕ4 mm and the fresh air inlet 15 is formed at the center of the flat region FR, the valve member mounting recess 7*a* is designed to be ϕ10 mm or more. Although the upper limit of the width W of the flat region FR is not particularly defined, the width W is preferably not too large because a larger width W of the flat region FR causes the valve member mounting recess 7*a* to have a greater area, and as a result, the area of the gap between the outer shell 12 and the shrink film. The upper limit is, for example, 10 mm. Accordingly, the width W is, for example, from 3 to 10 mm. Specifically, it is, for example, 3, 3.5, 4, 4.5, 5, 6, 7, 8, 9, and 10 mm or it may be in a range between any two values exemplified here.

According to an experiment (Second Experimental Example) by the present inventors, it is found that a wider flat region FR on an outer surface side of the outer shell 12 causes a larger radius of curvature on an inner surface of the outer shell 12, and when the flat region FR is provided across the range of 3 mm or more surrounding the fresh air inlet 15 on the outer surface side of the outer shell, the radius of curvature on the inner surface of the outer shell 12 is sufficiently large, and as a result, the close adherence between the outer shell 12 and the valve member 5 is improved. The radius of curvature on the inner surface of the outer shell 12 is preferably 200 mm or more in a range of 2 mm surrounding the fresh air inlet 15 and even more preferably 250 mm or more or 300 mm or more. This is because, when the radius of curvature has such value, the inner surface of the outer shell 12 substantially becomes flat and the close adherence between the outer shell 12 and the valve member 5 is good.

Figure 6A:
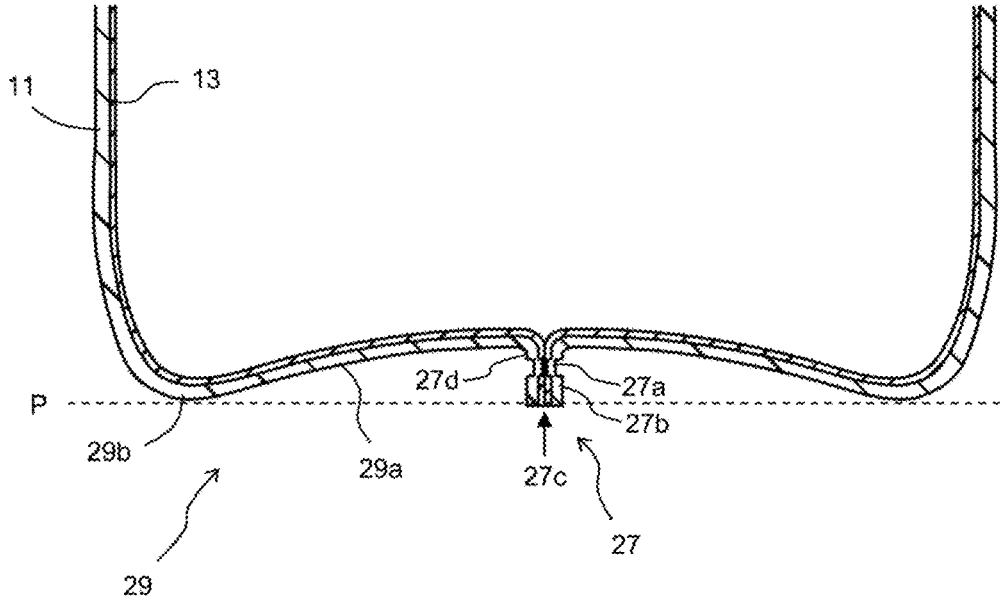
FIGS. 6A and 6B are enlarged views of a region including a bottom surface 29 in FIG. 3, where
Figure 6B:
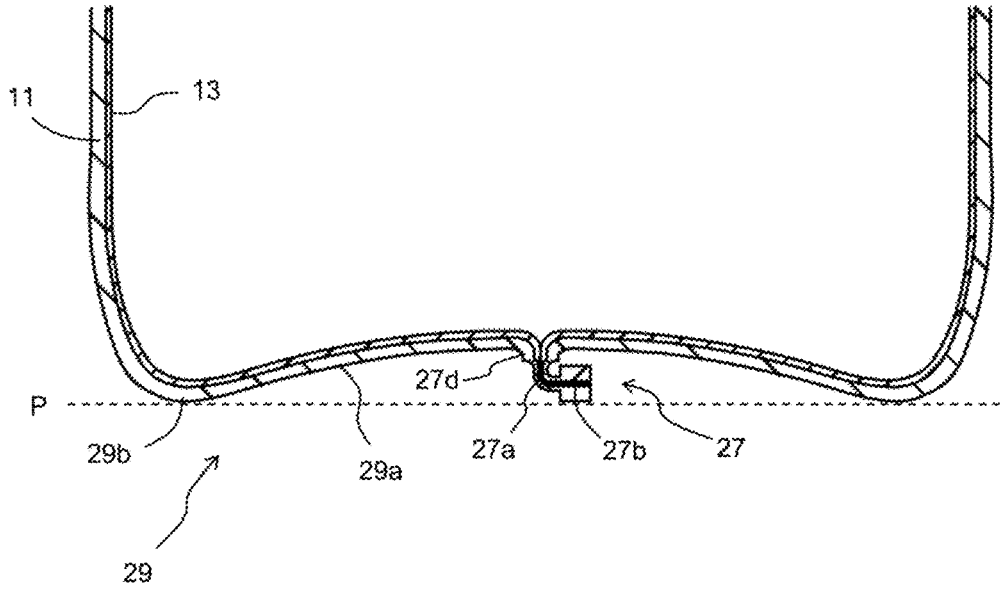

As illustrated in FIG. 1B, the storage portion 7 has a bottom surface 29 equipped with a central concave region 29*a* and a peripheral region 29*b* surrounding the former region, and the central concave region 29*a* is provided with a bottom seal protrusion 27 protruding from the bottom surface 29. As illustrated in FIGS. 6A and 6B, the bottom seal protrusion 27 is a sealing portion of a laminated parison in blow molding using a cylindrical laminated parison provided with the outer layer 11 and the inner layer 13. The bottom seal protrusion 27 is provided with, in order from the bottom surface 29 side, a base portion 27*d*, a thinner portion 27*a*, and a thicker portion 27*b* having a thickness greater than that of the thinner portion 27*a*.

Immediately after blow molding, as illustrated in FIG. 6A, the bottom seal protrusion 27 is in a state of standing approximately vertically to a plane P defined by the peripheral region 29*b*. In this state, however, when impact is applied to the container, the inner layers 13 in a welded portion 27*c* are prone to be separated from each other and the impact resistance is insufficient. In the present embodiment, the thinner portion 27*a* is softened by blowing hot air on the bottom seal protrusion 27 after blow molding to bend the bottom seal protrusion 27, as illustrated in FIG. 6B, in the thinner portion 27*a*. The impact resistance of the bottom seal protrusion 27 is thus improved simply by a simple procedure of bending the bottom seal protrusion 27. In addition, as illustrated in FIG. 6B, the bottom seal protrusion 27 does not protrude from the plane P defined by the peripheral region 29*b* in a state of being bent. This prevents, when the delaminatable container 1 is stood, instability of the delaminatable container 1 due to the bottom seal protrusion 27 sticking out of the plane P.

The base portion 27*d* is provided on the bottom surface 29 side closer than the thinner portion 27*a* and is an area thicker than the thinner portion 27*a*. Although the base portion 27*d* does not have to be provided, the impact resistance of the bottom seal protrusion 27 is further improved by providing the thinner portion 27*a* on the base portion 27*d*.

As illustrated in FIG. 1B, the concave region in the bottom surface 29 is provided across the entire bottom surface 29 in longitudinal directions of the bottom seal protrusion 27. That is, the central concave region 29*a* and the peripheral concave region 29*c* are connected. Such structure facilitates bending of the bottom seal protrusion 27.

The layer structure of the container body 3 is described below in further detail. The container body 3 is provided with the outer layer 11 and the inner layer 13.

The outer layer 11 is composed of, for example, low density polyethylene, linear low density polyethylene, high density polyethylene, polypropylene, an ethylene-propylene copolymer, a mixture thereof, and the like. The outer layer 11 may have a multilayer structure. For example, it may have a structure where a reproduction layer has both sides sandwiched by polypropylene layers. Here, the reproduction layer refers to a layer using burrs produced while molding a container by recycling. The outer layer 11 is formed thicker than the inner layer 13 for better restorability.

In the present embodiment, the outer layer 11 includes a random copolymer layer containing a random copolymer of propylene and another monomer. The outer layer 11 may be a single layer of the random copolymer layer or may be a multilayer structure. For example, it may have a structure where a reproduction layer has both sides sandwiched by random copolymer layers. The outer layer 11 is composed of a random copolymer of specific composition to improve shape restorability, transparency, and heat resistance of the outer shell 12.

The random copolymer has a content of a monomer other than propylene of less than 50 mol % and preferably from 5 to 35 mol %. Specifically, this content is, for example, 5, 10, 15, 20, 25, and 30 mol % or it may be in a range between any two values exemplified here. The monomer to be copolymerized with propylene may be one that improves impact resistance of the random copolymer compared with a homopolymer of polypropylene, and ethylene is particularly preferred. In the case of a random copolymer of propylene and ethylene, the ethylene content is preferably from 5 to 30 mol %. Specifically, it is, for example, 5, 10, 15, 20, 25, and 30 mol % or it may be in a range between any two values exemplified here. The random copolymer preferably has a weight average molecular weight from 100 thousands to 500 thousands, and even more preferably from 100 thousands to 300 thousands. Specifically, the weight average molecular weight is, for example, 100 thousands, 150 thousands, 200 thousands, 250 thousands, 300 thousands, 350 thousands, 400 thousands, 450 thousands, and 500 thousands or it may be in a range between any two values exemplified here.

The random copolymer has a tensile modulus of elasticity preferably from 400 to 1600 MPa and more preferably from 1000 to 1600 MPa. This is because the shape restorability is particularly good with a tensile modulus of elasticity in such range. Specifically, the tensile modulus of elasticity is, for example, 400, 500, 600, 700, 800, 900, 1000, 1100, 1200, 1300, 1400, 1500, and 1600 Mpa or it may be in a range between any two values exemplified here.

Since an excessively hard container impairs feeling of using the container, the outer layer 11 may be composed by, for example, mixing a softening material, such as linear low density polyethylene, to the random copolymer. Note that, in order not to severely interfere with effective properties of the random copolymer, the material to be mixed with the random copolymer is preferably mixed to be less than 50 weight % based on the entire mixture. For example, the outer layer 11 may be composed of a material in which the random copolymer is mixed with linear low density polyethylene at a weight ratio of 85:15.

Figure 7A:
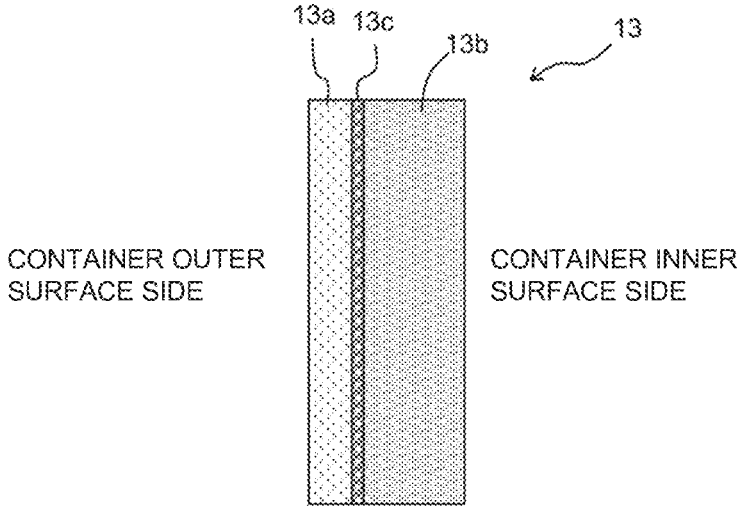
FIGS. 7A and 7B are cross-sectional views illustrating a layer structure of the inner layer 13.

As illustrated in FIG. 7A, the inner layer 13 includes an EVOH layer 13*a* provided on a container outer surface side, an inner surface layer 13*b* provided on a container inner surface side of the EVOH layer 13*a*, and an adhesion layer 13*c* provided between the EVOH layer 13*a* and the inner surface layer 13*b*. By providing the EVOH layer 13*a*, it is possible to improve gas barrier properties and delamination properties from the outer layer 11.

The EVOH layer 13*a* is a layer containing an ethylene-vinyl alcohol copolymer (EVOH) resin and is obtained by hydrolysis of a copolymer of ethylene and vinyl acetate. The EVOH resin has an ethylene content, for example, from 25 to 50 mol %, and from the perspective of oxygen barrier properties, it is preferably 32 mol % or less. Although not particularly defined, the lower limit of the ethylene content is preferably 25 mol % or more because the flexibility of the EVOH layer 13*a* is prone to decrease when the ethylene content is less. The EVOH layer 13*a* preferably contains an oxygen absorbent. The content of an oxygen absorbent in the EVOH layer 13*a* further improves the oxygen barrier properties of the EVOH layer 13*a*. The EVOH resin preferably has a modulus of elasticity in bending of 2350 MPa or less and even more preferably 2250 MPa or less. Although not particularly defined, the lower limit of the modulus of elasticity in bending of the EVOH resin is, for example, 1800, 1900, or 2000 MPa. The modulus of elasticity in bending is measured in a test method in accordance with ISO 178. The testing speed is 2 mm/min.

The EVOH resin preferably has a melting point higher than the melting point of the random copolymer contained in the outer layer 11. The fresh air inlet 15 is preferably formed in the outer layer 11 using a thermal perforator, and when the fresh air inlet 15 is formed in the outer layer 11, the inlet is prevented from reaching the inner layer 13 by the EVOH resin having a melting point higher than the melting point of the random copolymer. From this perspective, a greater difference of (Melting Point of EVOH)−(Melting Point of Random Copolymer Layer) is desired, and it is preferably 15° C. or more and particularly preferably 30° C. or more. The difference in melting points is, for example, from 5 to 50° C. Specifically, it is, for example, 5, 10, 15, 20, 25, 30, 35, 40, 45, and 50° C. or it may be in a range between any two values exemplified here.

The inner surface layer 13*b* is a layer to make contact with the contents of the delaminatable container 1. It contains, for example, polyolefin, such as low density polyethylene, linear low density polyethylene, high density polyethylene, polypropylene, an ethylene-propylene copolymer, and a mixture thereof, and preferably low density polyethylene or linear low density polyethylene. The resin contained in the inner surface layer 13*b* preferably has a tensile modulus of elasticity from 50 to 300 MPa and more preferably from 70 to 200 MPa. This is because the inner surface layer 13*b* is particularly flexible when the tensile modulus of elasticity is in such range. Specifically, the tensile modulus of elasticity is, for example, specifically for example, 50, 100, 150, 200, 250, and 300 Mpa or it may be in a range between any two values exemplified here.

The adhesion layer 13*c* is a layer having a function of adhering the EVOH layer 13*a* to the inner surface layer 13*b*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*c* is a mixture of acid modified polyethylene with low density polyethylene or linear low density polyethylene.

Figure 7B:
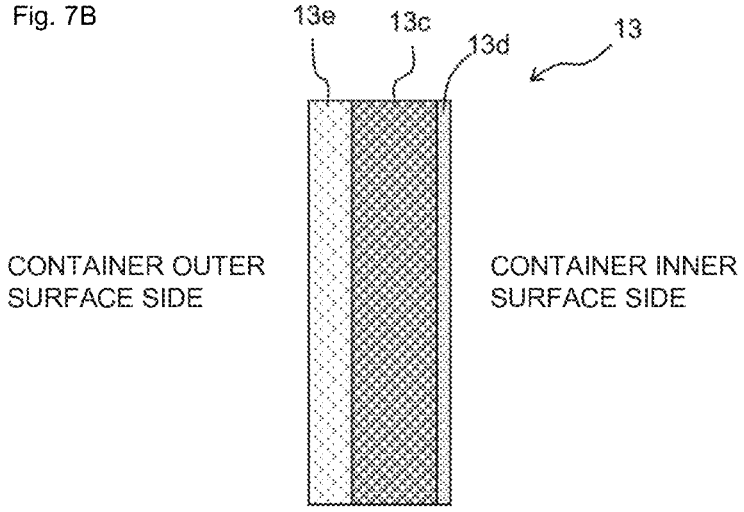
Figure 8:
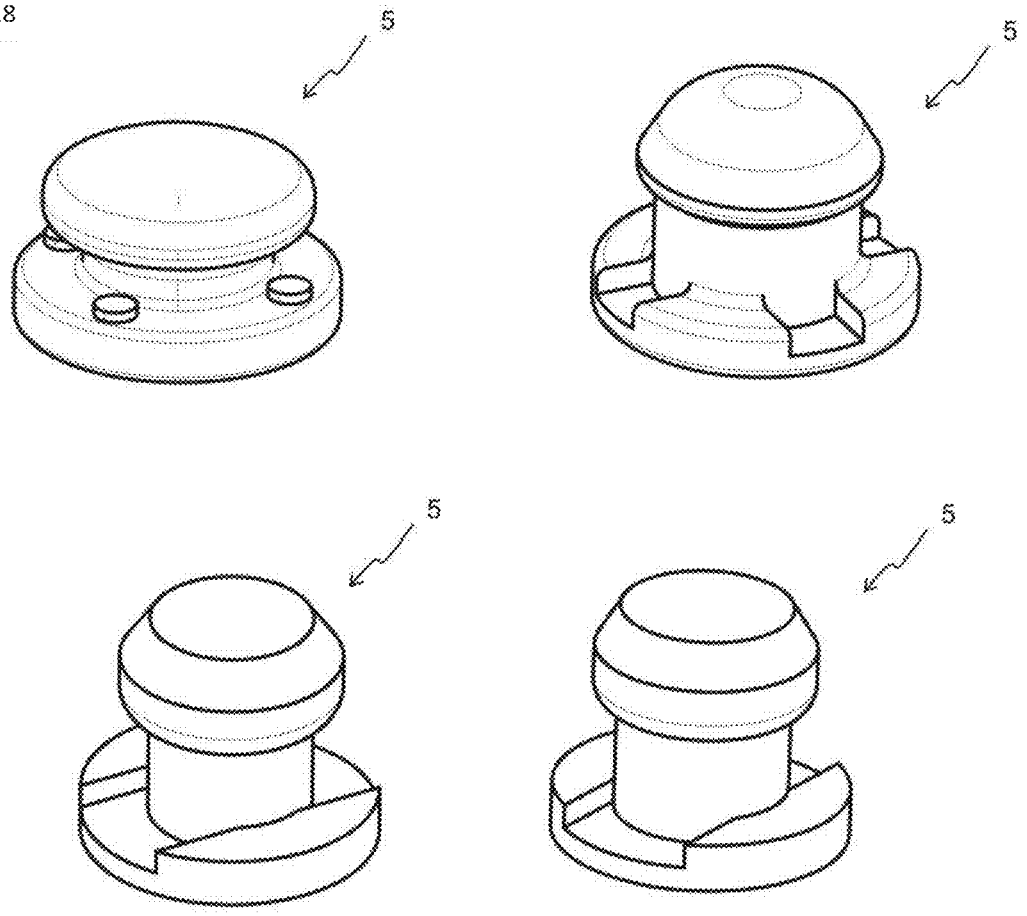
FIG. 8 is perspective views illustrating various structures of the valve member 5.

As illustrated in FIG. 7B, the inner layer 13 may have a structure to include an internal EVOH layer 13*d* as an innermost layer, an external EVOH layer 13*e* as an outermost layer, and the adhesion layer 13*c* provided between them.

The internal EVOH layer 13*d* contains an ethylene-vinyl alcohol copolymer (EVOH) resin. According to an experiment (Fourth Experimental Example) by the present inventors, it is found that, when the innermost layer of the inner layer 13 is the internal EVOH layer 13*d*, adsorption or absorption of limonene in the container inner surface is inhibited, and as a result, the reduction of the citrus aroma emitted by a citrus-based liquid condiment is inhibited.

Since EVOH resins have relatively high rigidity, such EVOH resin is normally used by adding a softening agent to the EVOH resin for use as a material for the inner layer 13 to improve the flexibility. There is a risk, however, in adding a softening agent to the EVOH resin contained in the internal EVOH layer 13*d* as the innermost layer of the inner layer 13 of eluting the softening agent in the contents. Therefore, as the EVOH resin contained in the internal EVOH layer 13*d*, one that does not contain a softening agent has to be used. Meanwhile, since the EVOH resin not containing a softening agent has high rigidity, a problem occurs that, when the internal EVOH layer 13*d* is too thick, the inner bag 14 is not prone to be shrunk smoothly at delivery of the contents. When the internal EVOH layer 13*d* is too thin, the internal EVOH layer 13*d* is not formed uniformly and there are problems that the adhesion layer 13*c* is exposed to the container inner surface and a pinhole is prone to be formed in the internal EVOH layer 13*d*. From such perspective, the internal EVOH layer 13*d* preferably has a thickness from 10 to 20 μm.

The EVOH resin contained in the internal EVOH layer 13*d* has an ethylene content, for example, from 25 to 50 mol %. Since a greater ethylene content facilitates improvement in flexibility of the internal EVOH layer 13*d*, the ethylene content is preferably higher than that of the EVOH resin contained in the external EVOH layer 13*e* and it is preferred to be 35 mol % or more. In other words, the EVOH resin contained in the internal EVOH layer 13*d* preferably has an ethylene content set to have a tensile modulus of elasticity of the EVOH resin of 2000 MPa or less.

The external EVOH layer 13*e* also contains an ethylene-vinyl alcohol copolymer (EVOH) resin similar to the internal EVOH layer 13*d*. Note that, since the external EVOH layer 13*e* does not make contact with the contents, the flexibility may be increased by adding a softening agent, and for that purpose, the external EVOH layer 13*e* may have a thickness thicker than that of the internal EVOH layer. Although not particularly limited, the external EVOH layer 13*e* has a thickness, for example, from 20 to 30 μm. A problem occurs that the gas barrier properties of the inner layer 13 become insufficient when the external EVOH layer 13*e* is too thin, and another occurs that the flexibility of the inner layer 13 becomes insufficient when the external EVOH layer 13*e* is too thick, causing the inner bag 14 not prone to be shrunk smoothly at delivery of the contents. Although not particularly limited, a ratio of thicknesses of the external EVOH layer 13*e*/internal EVOH layer 13*d* is, for example, from 1.1 to 4 and preferably from 1.2 to 2.0. Specifically, the ratio is, for example, 1.1, 1.2, 1.3, 1.4, 1.5, 1.6, 1.7, 1.8, 1.9, 2, 2.1, 2.2, 2.3, 2.4, 2.5, 3, and 4 or it may be in a range between any two values exemplified here. By providing the external EVOH layer 13*e* as the outermost layer of the inner layer 13, it is possible to improve the delamination properties of the inner layer 13 from the outer layer 11.

The EVOH resin contained in the external EVOH layer 13*e* has an ethylene content, for example, from 25 to 50 mol %, and from the perspective of oxygen barrier properties, it is preferably 32 mol % or less. Although not particularly defined, the lower limit of the ethylene content is preferably 25 mol % or more because a less ethylene content causes a decrease in flexibility of the external EVOH layer 13*e*.

It is preferred that an amount of adding the softening agent to the EVOH resin contained in the external EVOH layer 13*e* and the ethylene content of the EVOH resin are set in such a manner that the EVOH resin has a tensile modulus of elasticity of 2000 MPa or less. Composition of both the internal EVOH layer 13*d* and the external EVOH layer 13*e* by EVOH resins having a tensile modulus of elasticity of 2000 MPa or less enables smooth shrinking of the inner bag 14. The external EVOH layer 13*e* preferably contains an oxygen absorbent. By containing an oxygen absorbent in the external EVOH layer 13*e*, it is possible to further improve the oxygen barrier properties of the external EVOH layer 13*e*.

The EVOH resin contained in the external EVOH layer 13*e* preferably has a melting point higher than the melting point of the random copolymer contained in the outer layer 11. The fresh air inlet 15 is preferably formed in the outer layer 11 using a thermal perforator, and when the fresh air inlet 15 is formed in the outer layer 11, the inlet is prevented from reaching the inner layer 13 by the EVOH resin having a melting point higher than the melting point of the random copolymer. From this perspective, a greater difference of (Melting Point of EVOH)−(Melting Point of Random Copolymer Layer) is desired, and it is preferably 15° C. or more and particularly preferably 30° C. or more. The difference in melting points is, for example, from 5 to 50° C. Specifically, it is, for example, 5, 10, 15, 20, 25, 30, 35, 40, 45, and 50° C. or it may be in a range between any two values exemplified here.

The adhesion layer 13*c* is a layer arranged between the internal EVOH layer 13*d* and the external EVOH layer 13*e*, and it is, for example, a product of adding acid modified polyolefin (e.g., maleic anhydride modified polyethylene) with carboxyl groups introduced therein to polyolefin described above or an ethylene-vinyl acetate copolymer (EVA). An example of the adhesion layer 13*c* is a mixture of acid modified polyethylene with low density polyethylene or linear low density polyethylene. The adhesion layer 13*c* may directly adhere the internal EVOH layer 13*d* to the external EVOH layer 13*e* or may indirectly adhere via another layer provided between the adhesion layer 13*c* and the internal EVOH layer 13*d* or between the adhesion layer 13*c* and the external EVOH layer 13*e*.

The adhesion layer 13*c* is a layer having rigidity per unit thickness less than that of any of the internal EVOH layer 13*d* and the external EVOH layer 13*e*, that is, a layer excellent in flexibility. Therefore, by thickening the adhesion layer 13*c* to increase the ratio of the thickness of the adhesion layer 13*c* to the thickness of the entire inner layer 13, the flexibility of the inner layer 13 is increased and the inner bag 14 readily shrinks smoothly at delivery of the contents. Specifically, the adhesion layer 13*c* preferably has a thickness greater than a total of the thickness of the internal EVOH layer 13*d* and the thickness of the external EVOH layer 13*e*. The ratio of thicknesses of Adhesion Layer 13*c*/(Internal EVOH Layer 13*d*+External EVOH Layer 13*e*) is, for example, from 1.1 to 8. Specifically, the ratio is, for example, 1.1, 1.5, 2, 2.5, 3, 3.5, 4, 4.5, 5, 5.5, 6, 7, and 8 or it may be in a range between any two values exemplified here.

Then, an example of a method of manufacturing the delaminatable container 1 in the present embodiment is described.

Figures 9A, 9B, 9C, 9D, 9E, 9F:
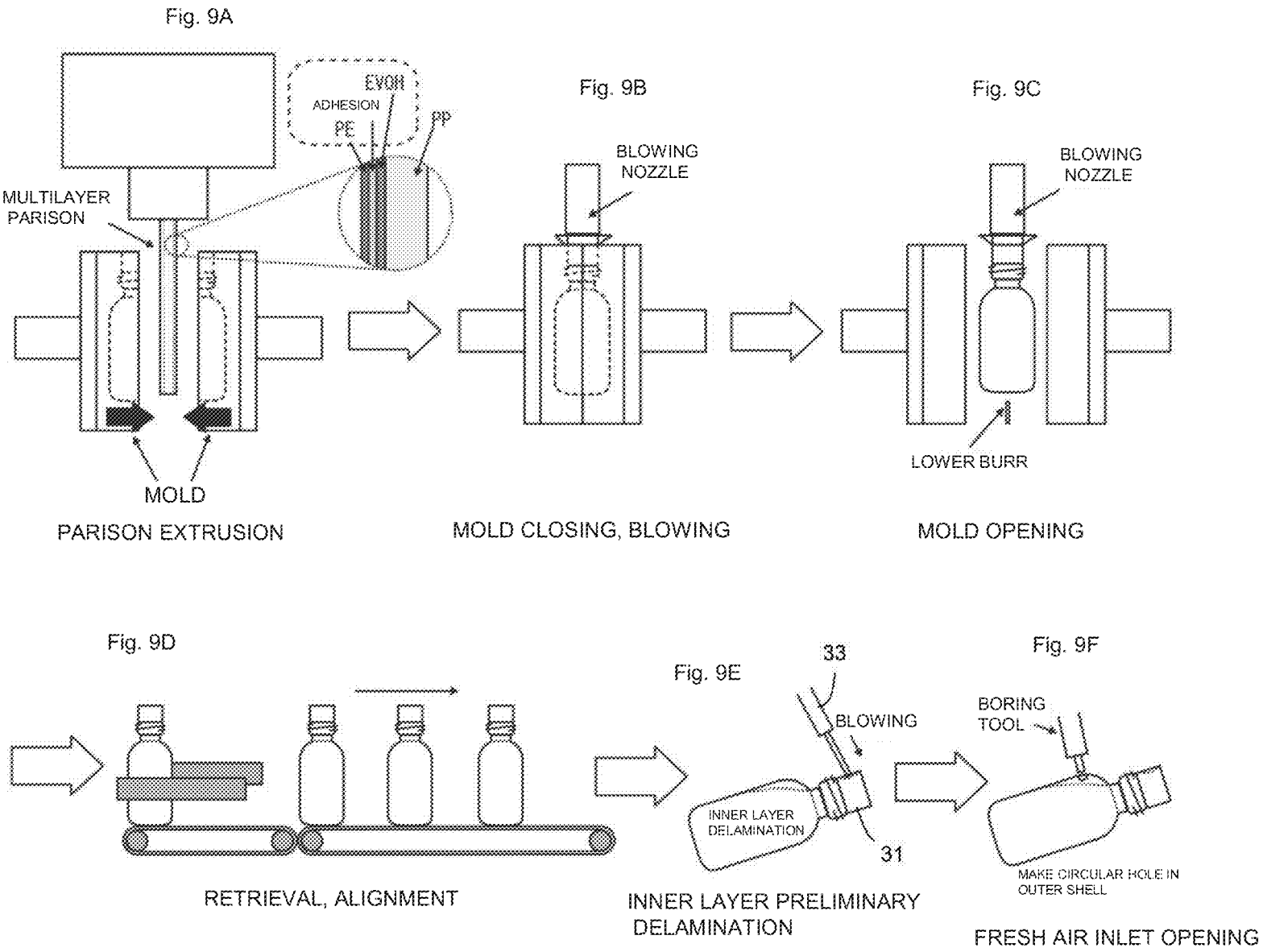
FIGS. 9A through 9F illustrate a procedure of manufacturing the delaminatable container 1 in FIGS. 1A through 1C.

Firstly, as illustrated in FIG. 9A a laminated parison in a melted state with a laminated structure (in an example, as illustrated in FIG. 9A, a laminated structure of PE layer/adhesion layer/EVOH layer/PP layer in order from the container inner surface side) corresponding to the container body 3 to be manufactured is extruded to set the laminated parison in the melted state in a blow molding die and the split die is closed.

Then, as illustrated in FIG. 9B, a blowing nozzle is inserted into an opening of the mouth 9 of the container body 3 to blow air into a cavity of the split die in the mold closing state.

Then, as illustrated in FIG. 9C, the split die is opened to take out a blow molded article. The split die has a cavity shape to form various shapes of the container body 3, such as the valve member mounting recess 7*a*, the air circulation groove 7*b*, and the bottom seal protrusion 27, in the blow molded article. The split die is provided with a pinch-off below the bottom seal protrusion 27. Lower burrs are thus formed in the area below the bottom seal protrusion 27 and they are removed.

Then, as illustrated in FIG. 9D, blow molded articles thus taken out are aligned.

Then, as illustrated in FIG. 9E, a hole is made only in the outer layer 11 in an upper tubular portion 31 provided above the mouth 9 to blow air between the outer layer 11 and the inner layer 13 using a blower 33 for preliminary delamination of the inner layer 13 from the outer layer 11 in a portion, of the storage portion 7, to mount the valve member 5 (valve member mounting recess 7*a*). The preliminary delamination facilitates a procedure to form the fresh air inlet 15 and a procedure to mount the valve member 5. To prevent leakage of the blown air from the end side of the upper tubular portion 31, the end side of the upper tubular portion 31 may be covered with a cover member. In order to facilitate making a hole only in the outer layer 11, the inner layer 13 may delaminate from the outer layer 11 in the upper tubular portion 31 by squashing the upper tubular portion 31 before making a hole. The preliminary delamination may be applied to the entire storage portion 7 or to part of the storage portion 7.

Then, as illustrated in FIG. 9F, the fresh air inlet 15 is formed in the outer shell 12 using a boring tool. The fresh air inlet is preferably a circular hole while it may be in another shape.

The procedures of inner layer preliminary delamination and fresh air inlet opening may be in the following method.

Figures 10A, 10B, 10C, 10D:
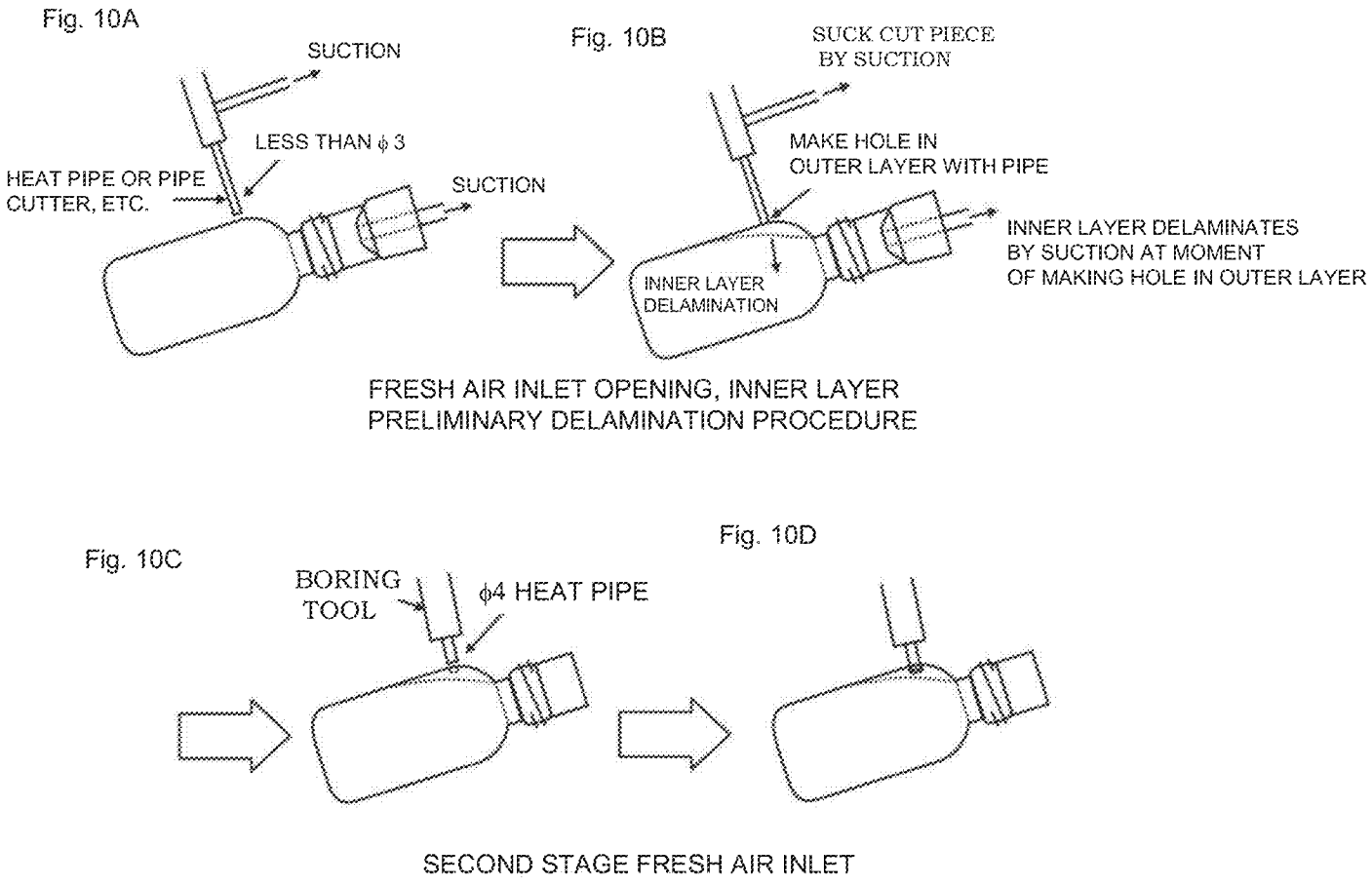
FIGS. 10A through 10D illustrate another example of inner layer preliminary delamination and fresh air inlet formation procedures.

Firstly, as illustrated in FIG. 10A, the air in the inner bag 14 is sucked from the mouth 9 to reduce the pressure in the inner bag 14. In this state, a perforator, such as a heat pipe or a pipe cutter, is gradually pressed against the outer layer 11. The perforator has a tubular cutter and the air inside the tube is sucked. In a state where a hole is not made in the outer layer 11, no air enters between the outer layer 11 and the inner layer 13 and thus the inner layer 13 does not delaminate from the outer layer 11.

When the tubular cutter penetrates the outer layer 11, as illustrated in FIG. 10B, the cut piece that is hollowed out is removed through the tubular cutter and the fresh air inlet 15 is formed. At this moment, air enters between the outer layer 11 and the inner layer 13 and the inner layer 13 delaminates from the outer layer 11.

Then, as illustrated in FIGS. 10C and 10D, the diameter of the fresh air inlet 15 is enlarged using a boring tool. When the fresh air inlet 15 in a size sufficient for insertion of the valve member 5 is formed in the procedures in FIGS. 10A and 10B, the diameter enlargement procedure in FIGS. 10C and 10D are not required.

The procedures of inner layer preliminary delamination and fresh air inlet opening may be in the following method. Here, with reference to FIGS. 11A through 11F, a method is described in which the fresh air inlet 15 is formed in the outer shell 12 of the delaminatable container 1 using a thermal perforator 2, followed by preliminary delamination.

Figures 11A, 11B, 11C, 11D, 11E, 11F:
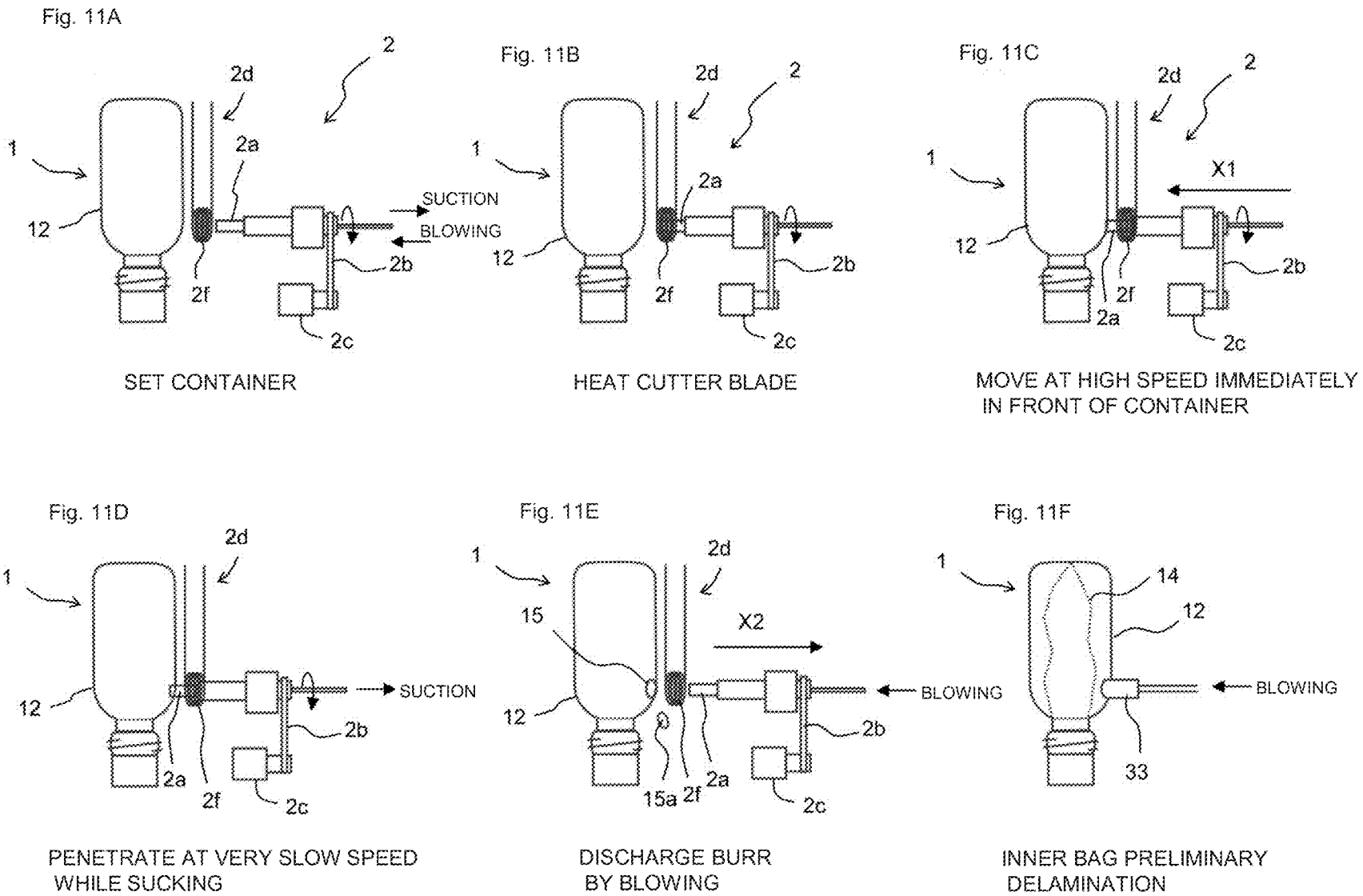
FIGS. 11A through 11F illustrate another example of the inner layer preliminary delamination and fresh air inlet formation procedures.

Firstly, as illustrated in FIG. 11A, the delaminatable container 1 is set in a position in proximity to the perforator 2. The perforator 2 is provided with a tubular cutter blade 2*a*, a motor 2*c* to rotationally drive the cutter blade 2*a* through a transmission belt 2*b*, and a heating device 2*d* to heat the cutter blade 2*a*. The perforator 2 is supported by a servo cylinder (not shown) to single-axis move the perforator 2 by rotation of a servo motor and is configured movably in an arrow X1 direction in FIG. 11C and in an arrow X2 direction in FIG. 11E. Such structure enables rotation of the heated cutter blade 2*a* while pressing the edge against the outer shell 12 of the delaminatable container 1. The control of the position and the moving speed of the perforator 2 by the servo motor enables reduction in tact time.

The cutter blade 2*a* is coupled to a ventilation pipe 2*e* in communication with a hollow in the cutter blade 2*a*, and the ventilation pipe 2*e* is coupled to an air intake and exhaust system, not shown. This enables air suction from inside the cutter blade 2*a* and air blowing inside the cutter blade 2*a*. The heating device 2*d* is provided with a coil 2*f* formed of a conductive wire and configured to heat the cutter blade 2*a* by the principle of electromagnetic induction by applying an alternating current to the coil 2*f*. The heating device 2*d* is arranged in proximity to a blow molded article 1*a* and separate from the cutter blade 2*a*. Such structure simplifies wiring of the heating device 2*d* and enables efficient heating of the edge of the cutter blade 2*a*.

Then, as illustrated in FIG. 11B, the perforator 2 is brought close to the delaminatable container 1 for penetration of the cutter blade 2*a* into the coil 2*f*. By applying an alternating current to the coil 2*f* in this state, the cutter blade 2*a* is heated.

Then, as illustrated in FIG. 11C, the perforator 2 is moved at high speed in the arrow X1 direction to the position where the edge of the cutter blade 2*a* reaches immediately in front of the delaminatable container 1.

Then, as illustrated in FIG. 11D, while a suction force is exerted on the edge of the cutter blade 2*a* by sucking air inside the cutter blade 2*a*, the perforator 2 is brought close to the delaminatable container 1 at very slow speed for penetration of the edge of the cutter blade 2*a* into the outer shell 12 of the delaminatable container 1. Such combination of high speed movement and very slow speed movement enables reduction in tact time. Although the entire perforator 2 is moved in the present embodiment, another embodiment may apply where only the cutter blade 2*a* is moved by a cylinder mechanism or the like and the cutter blade 2*a* is moved at high speed to the position where the edge of the cutter blade 2*a* reaches immediately in front of the delaminatable container 1 and the cutter blade 2*a* is moved at very slow speed for penetration of the cutter blade 2*a* into the outer shell 12.

Figure 12A:
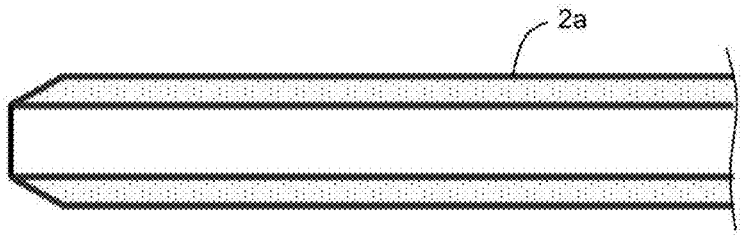
FIGS. 12A and 12B are cross-sectional views illustrating the shape of tubular cutter blade edges, where
Figure 12B:
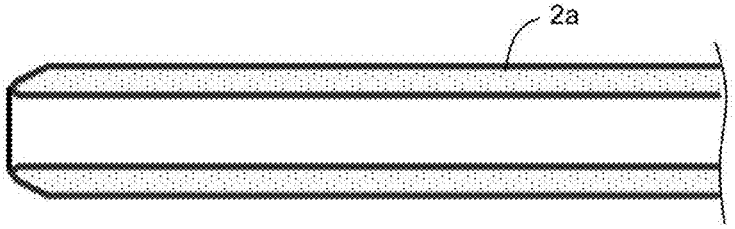

When the edge of the cutter blade 2*a* reaches the boundary between the outer shell 12 and the inner bag 14, the outer shell 12 is hollowed out in the shape of the edge of the cutter blade 2*a* to form the fresh air inlet 15. A cut piece 15*a* that is hollowed out of the outer shell 12 is sucked in the hollow of the cutter blade 2*a*. The cutter blade 2*a* may stop the movement when the edge reaches the boundary between the outer shell 12 and the inner bag 14, whereas it may be moved until the edge of the cutter blade 2*a* is pressed against the inner bag 14 beyond the interface between the outer shell 12 and the inner bag 14 to form the fresh air inlet 15 more securely. At this point, to inhibit damage in the inner bag 14 by the cutter blade 2*a*, the shape of the edge of the cutter blade 2*a* is preferably a rounded shape as illustrated in FIG. 12B to a sharp shape as illustrated in FIG. 12A. Although the fresh air inlet 15 is not easily formed in the outer shell 12 with a rounded edge of the cutter blade 2*a*, the present embodiment enables easy formation of the fresh air inlet 15 in the outer shell 12 by rotating the heated cutter blade 2*a*. Not to melt the inner bag 14 by the heat of the cutter blade 2*a*, the resin contained in the outermost layer of the inner bag 14 preferably has a melting point higher than the melting point of the resin contained in the innermost layer of the outer shell 12.

Then, as illustrated in FIG. 11E, the perforator 2 is set back in the arrow X2 direction to blow air into the hollow of the cutter blade 2*a*, thereby emitting the cut piece 15*a* from the edge of the cutter blade 2*a*.

In the above procedures, formation of the fresh air inlet 15 in the outer shell 12 is completed.

Then, as illustrated in FIG. 11F, air is blown between the outer shell 12 and the inner bag 14 through the fresh air inlet 15 using the blower 33 for preliminary delamination of the inner bag 14 from the outer shell 12. By blowing air in a defined amount while avoiding air leakage through the fresh air inlet 15, preliminary delamination of the inner bag 14 is readily controlled. Although the preliminary delamination may be applied to the entire storage portion 7 or may be applied to part of the storage portion 7, it is preferred that preliminary delamination of the inner bag 14 from the outer shell 12 in approximately the entire storage portion 7 because it is not possible to check the presence of a pinhole in the inner bag 14 in a portion not subjected to preliminary delamination.

Figure 13A:
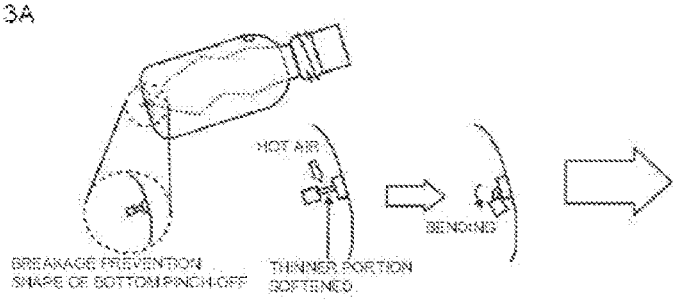
FIGS. 13A through 13H illustrate the procedure of manufacturing the delaminatable container 1 in FIGS. 1A through 1C following FIGS. 11A through 11F.

Then, as illustrated in FIG. 13A, the thinner portion 27*a* is softened by exposing the bottom seal protrusion 27 to hot air to bend the bottom seal protrusion 27.

Figure 13B:
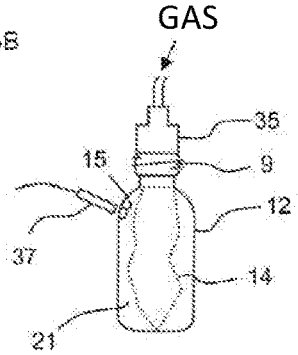

Then, as illustrated in FIG. 13B, the inner bag 14 is checked for a pinhole. Specifically, firstly, an adapter 35 is mounted to the mouth 9 and an inspection gas containing a specific type of gas is injected in the inner bag 14 through the mouth 9. When a pinhole is present in the inner bag 14, the specific type of gas leaks to the intermediate space 21 through the pinhole and is discharged outside the container through the fresh air inlet 15 from the intermediate space 21. Outside the container, in a position in proximity to the fresh air inlet 15, a sensor (detector) 37 for the specific type of gas is arranged, which enables sensing of leakage of the specific type of gas. When the concentration of the specific type of gas sensed by the sensor 37 is at a threshold or less, determination is made that a pinhole is not present in the inner bag 14 and the delaminatable container 1 is determined as a good product. In contrast, when the concentration of the specific type of gas sensed by the sensor 37 exceeds the threshold, determination is made that a pinhole is present in the inner bag 14 and the delaminatable container 1 is determined as a defective product. The delaminatable container 1 determined as a defective product is removed from the production line.

As the specific type of gas, a type of gas present in a less amount in the air (preferably a type of gas at 1% or less) is selected preferably and examples of it may include hydrogen, carbon dioxide, helium, argon, neon, and the like. The concentration of the specific type of gas in the inspection gas is not particularly limited, and the inspection gas may be composed only of the specific type of gas or may be a mixed gas of air and the specific type of gas.

Although not particularly limited, the injection pressure of the inspection gas is, for example, from 1.5 to 4.0 kPa. When the injection pressure is too low, the leakage of the specific type of gas is sometimes too little to sense the specific type of gas even though a pinhole is present. When the injection pressure is too high, the inner bag 14 expands and is pressed against the outer shell 12 immediately after injection of the inspection gas, resulting in a decrease in accuracy of check for a pinhole of the inner bag 14.

Although the sensor 37 is arranged outside the delaminatable container 1 in proximity to the fresh air inlet 15 in the present embodiment, the sensor 37 may be inserted into the intermediate space 21 through the fresh air inlet 15 to detect the specific type of gas in the intermediate space 21 as a modification. In this case, it is possible to sense the specific type of gas before diffusion of the specific type of gas passing through a pinhole in the inner bag 14, and thus the accuracy of sensing the specific type of gas is improved. As still another modification, the inspection gas containing the specific type of gas may be injected in the intermediate space 21 from the fresh air inlet 15 to sense the specific type of gas leaked to the inner bag 14 through a pinhole in the inner bag 14. In this case, the sensor 37 may be arranged outside the container in a position in proximity to the mouth 9 or the sensor 37 may be inserted into the inner bag 14 from the mouth 9.

The delaminatable container 1 after checked for a pinhole may be forwarded directly to a next procedure, whereas in a modification it may be forwarded to a next procedure after a procedure of expanding the inner bag 14 by blowing air into the inner bag 14. In the case of the latter, an air blowing procedure in FIG. 13E may be omitted.

Figure 13C:
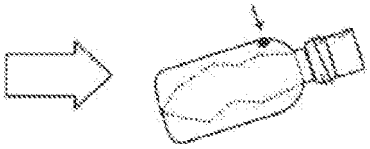

Then, as illustrated in FIG. 13C, the valve member 5 is inserted into the fresh air inlet 15.

Figure 13D:
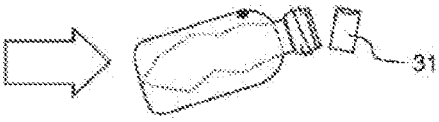

Then, as illustrated in FIG. 13D, the upper tubular portion 31 is cut.

Figure 13E:
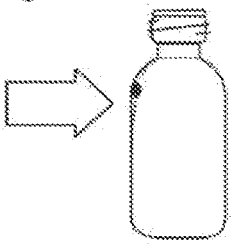

Then, as illustrated in FIG. 13E, the inner bag 14 is expanded by blowing air into the inner bag 14.

Figure 13F:
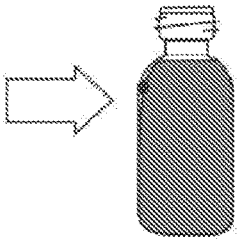

Then, as illustrated in FIG. 13F, the inner bag 14 is filled with the contents.

Figure 13G:
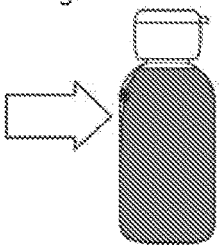

Then, as illustrated in FIG. 13G, the cap 23 is mounted on the mouth 9.

Figure 13H:
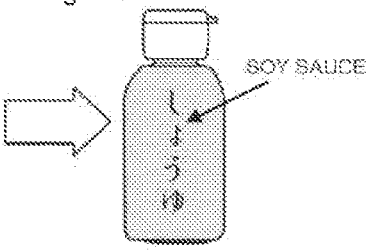

Then, as illustrated in FIG. 13H, the storage portion 7 is covered with a shrink film to complete the product.

The order of various procedures described here may be switched appropriately. For example, the hot air bending procedure may be before the fresh air inlet opening procedure or may be before the inner layer preliminary delamination procedure. The procedure of cutting the upper tubular portion 31 may be before inserting the valve member 5 into the fresh air inlet 15.

Then, working principle of the product thus manufactured in use is described.

As illustrated in FIGS. 14A through 14C, in a state where the product filled with the contents, a side of the outer shell 12 is squeezed for compression to deliver the contents. At the start of use, there is substantially no gap between the inner bag 14 and the outer shell 12, and thus the compressive force applied to the outer shell 12 directly becomes a compressive force to the inner bag 14 and the inner bag 14 is compressed to deliver the contents.

The cap 23 has a built-in check valve, not shown, so that it is capable of delivering the contents in the inner bag 14 but not capable of taking fresh air in the inner bag 14. Therefore, when the compressive force applied to the outer shell 12 is removed after delivery of the contents, the outer shell 12 attempts to be back in the original shape by the restoring force of itself but the inner bag 14 remains deflated and only the outer shell 12 expands. Then, as illustrated in FIG. 14D, inside the intermediate space 21 between the inner bag 14 and the outer shell 12 is in a reduced pressure state to introduce fresh air in the intermediate space 21 through the fresh air inlet 15 formed in the outer shell 12. When the intermediate space 21 is in a reduced pressure state, the lid 5*c* is not pressed against the fresh air inlet 15 and thus it does not interfere with introduction of fresh air. Not to cause the locking portion 5*b* to interfere with introduction of fresh air even in a state where the locking portion 5*b* makes contact with the outer shell 12, the locking portion 5*b* is provided with an air passage securing mechanism, such as the projections 5*d* and grooves.

Then, as illustrated in FIG. 14E, when the side of the outer shell 12 is again squeezed for compression, the lid 5*c* closes the fresh air inlet 15 to increase the pressure in the intermediate space 21, and the compressive force applied to the outer shell 12 is transmitted to the inner bag 14 via the intermediate space 21 and the inner bag 14 is compressed by this force to deliver the contents.

Then, as illustrated in FIG. 14F, when the compressive force applied to the outer shell 12 is removed after delivery of the contents, the outer shell 12 is restored in the original shape by the restoring force of itself while fresh air is introduced in the intermediate space 21 from the fresh air inlet 15.

2. Second Embodiment

Figure 15A:
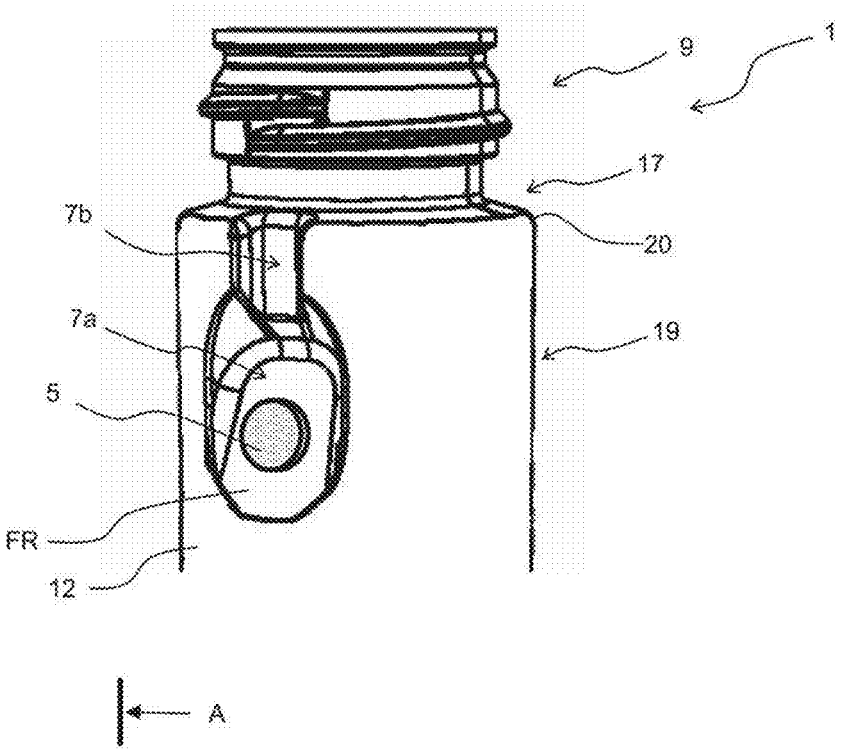
FIGS. 15A through 15C illustrate a structure of a delaminatable container 1 in a second embodiment of the present invention, where
Figure 15B:
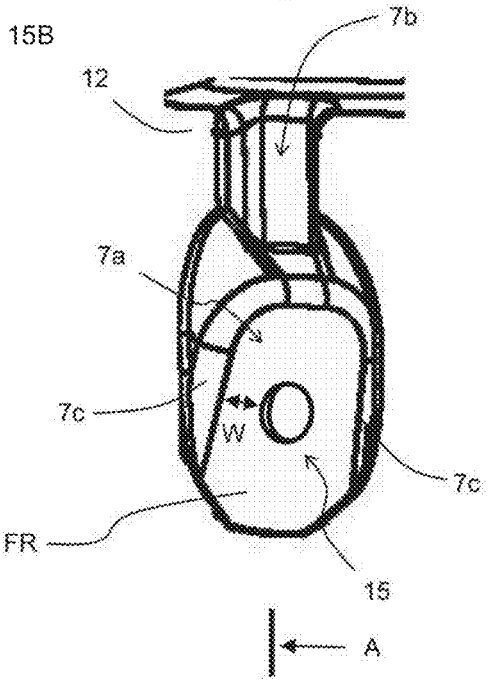

Then, with reference to FIGS. 15A and 15B, a delaminatable container 1 in a second embodiment of the present invention is described. The delaminatable container 1 in the present embodiment has the layer structure and the functions same as those in the first embodiment, whereas it is different in a specific shape. The delaminatable container 1 in the present embodiment is particularly different in the configuration of and around a valve member mounting recess 7*a* from the first embodiment, and thus the descriptions are given below mainly on this point.

As illustrated in FIG. 15A, the delaminatable container 1 in the present embodiment is structured by coupling a mouth 9 to a main portion 19 by a shoulder portion 17. While the bent portion 22 is provided in the shoulder portion 17 in the first embodiment, the shoulder portion 17 is not provided with a bent portion 22 in the present embodiment and the boundary between the shoulder portion 17 and the main portion 19 functions in the same manner as the bent portion 22 to inhibit delamination of an inner bag 14 from reaching the mouth 9.

Figure 15C:
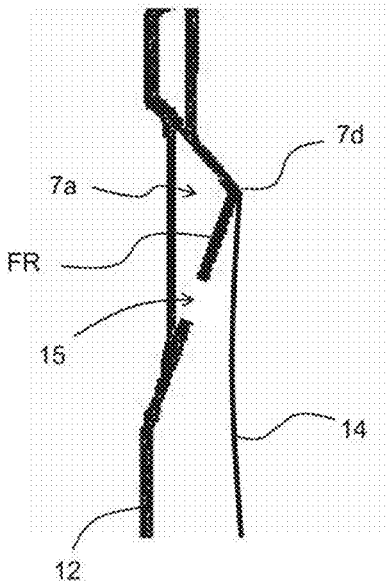
Figure 16A:
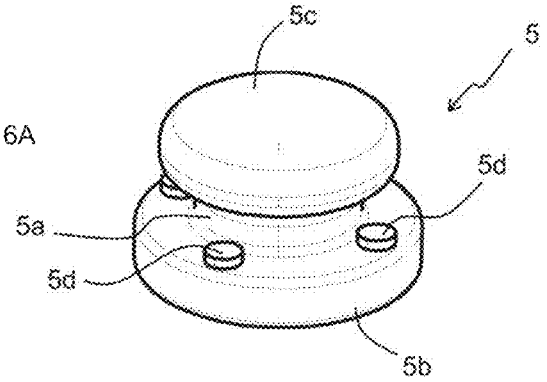
FIGS. 16A and 16B illustrate a first structural example of the valve member 5, where
Figure 16B:
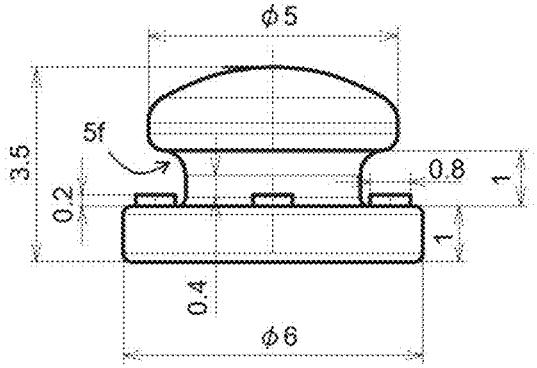
Figure 17A:
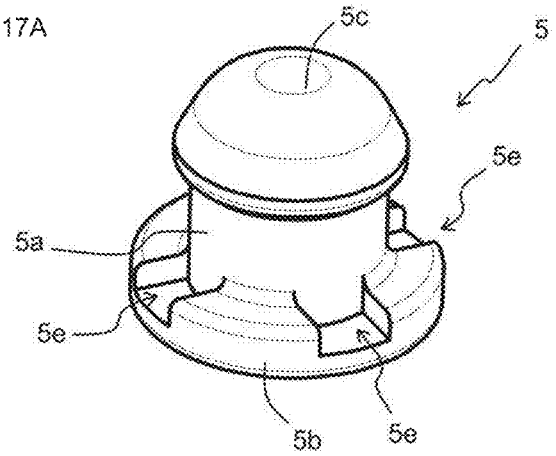
FIGS. 17A and 17B illustrate a second structural example of the valve member 5, where
Figure 17B:
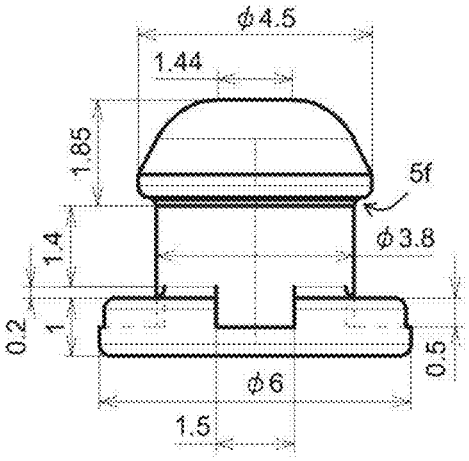
Figure 18A:
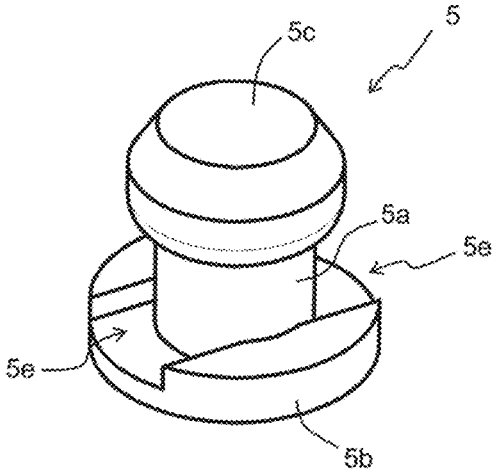
FIGS. 18A and 18B illustrate a third structural example of the valve member 5, where
Figure 18B:
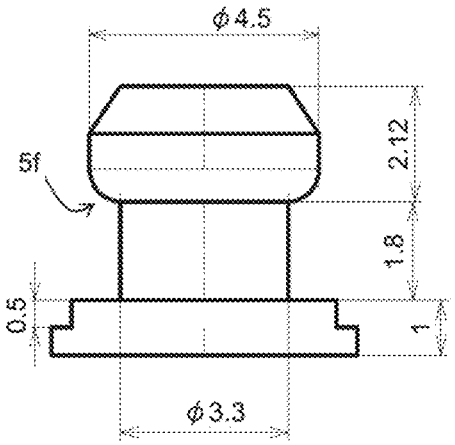
Figure 19A:
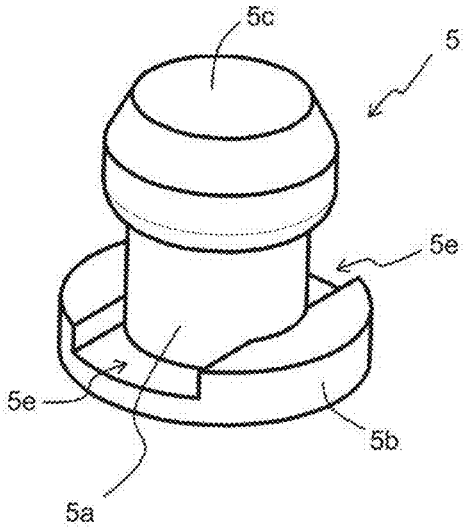
FIGS. 19A and 19B illustrate a fourth structural example of the valve member 5, where
Figure 19B:
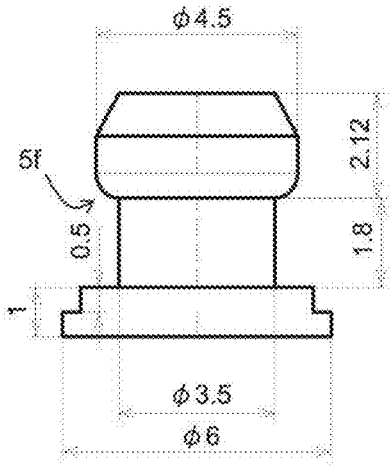

The valve member mounting recess 7*a* is provided in the main portion 19 composed of an approximately vertical wall, and the valve member mounting recess 7*a* is equipped with a flat region FR. The flat region FR is an inclined surface at approximately 70 degrees. The flat region FR is provided with a fresh air inlet 15, and a width W of the flat region FR surrounding the fresh air inlet 15 is 3 mm or more same as in the first embodiment. The valve member mounting recess 7*a* has side walls 7*c* of tapered surfaces extending toward outside to facilitate a die to form the valve member mounting recess 7*a* to be taken away. As illustrated in FIG. 15C, the inner bag 14 starts from an upper edge 7*d* of the flat region FR for ease of delamination.

3. Third Embodiment

Then, with reference to FIGS. 21A through 21E, a delaminatable container 1 in a third embodiment of the present invention is described. The delaminatable container 1 in the present embodiment has the layer structure and the functions same as those in the first and second embodiments, whereas it is different in the structure of a valve member 5.

Specifically, the valve member 5 in the present embodiment has a locking portion 5*b* provided with a pair of foundation portions 5*b*1 and a bridge portion 5*b*2 disposed between the foundation portions 5*b*1. An axis 5*a* is provided on the bridge portion 5*b*2.

The lid 5*c* is configured to substantially close the fresh air inlet 15 when the outer shell 12 is compressed and is provided with a tapered surface 5*d* to have a smaller cross-sectional area as coming closer to the axis 5*a*. An inclination angle β of the tapered surface 5*d* illustrated in FIG. 21C is preferably from 15 to 45 degrees to a direction D in which the axis 5*a* extends and even more preferably from 20 to 35 degrees. This is because air leakage is prone to occur when the inclination angle β is too large and the valve member 5 becomes long when too small.

Figure 21A:
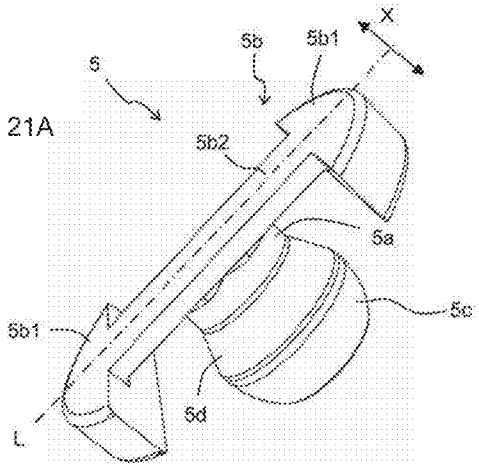
FIGS. 21A through 21E illustrate a valve member 5 of a delaminatable container 1 in a third embodiment of the present invention, where
Figure 21B:
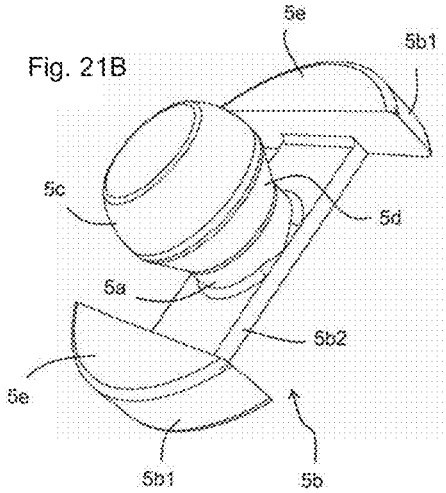
Figure 21C:
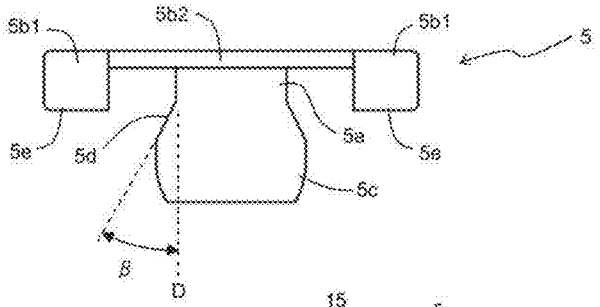
Figure 21D:
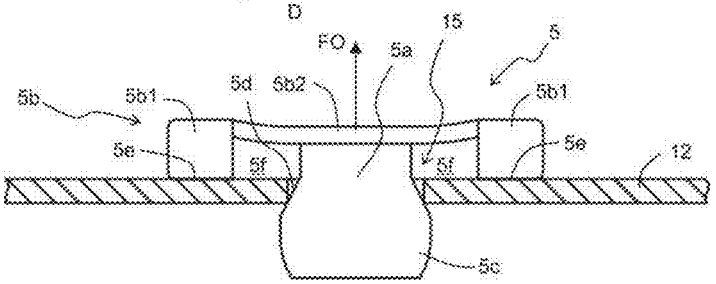

As illustrated in FIG. 21D, the locking portion 5*b* is configured, in a state of mounted to the fresh air inlet 15, in such a manner that the foundation portions 5*b*1 has abutment surfaces 5*e* to abut on the outer shell 12 and the bridge portion 5*b*2 deflects. According to such structure, a restoring force is generated in the bridge portion 5*b*2 in a direction separating from the container as illustrated by an arrow FO, thereby exerting a biasing force in the same direction on the lid 5*c* to press the lid 5*c* against the outer shell 12.

In this state, the lid 5*c* is only lightly pressed against the outer shell 12. However, when the outer shell 12 is compressed, the pressure in the intermediate space 21 becomes higher than external pressure and the pressure difference causes the lid 5*c* to be even stronger pressed against the fresh air inlet 15 to close the fresh air inlet 15 by the lid 5*c*. Since the lid 5*c* is equipped with the tapered surface 5*d*, the lid 5*c* readily fits into the fresh air inlet 15 to close the fresh air inlet 15.

Figure 21E:
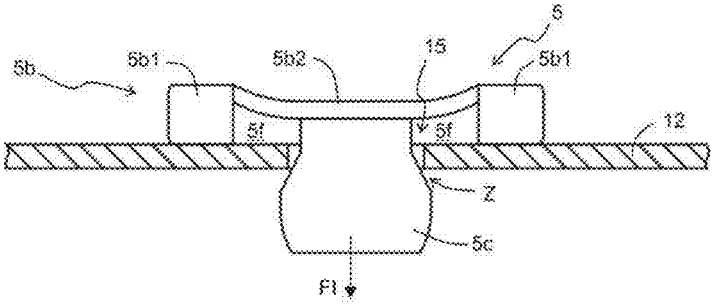

When the outer shell 12 is further compressed in this state, the pressure in the intermediate space 21 is increased, and as a result, the inner bag 14 is compressed to deliver the contents in the inner bag 14. When the compressive force to the outer shell 12 is released, the outer shell 12 attempts to restore its shape by the elasticity of its own. The pressure in the intermediate space 21 is reduced with the restoration of the outer shell 12, thereby applying a force FI, as illustrated in FIG. 21E, in a direction inside the container to the lid 5*c*. This increases the deflection of the bridge portion 5*b*2 and forms a gap Z between the lid 5*c* and the outer shell 12 to introduce fresh air in the intermediate space 21 through a path 5*f* between the bridge portion 5*b*2 and the outer shell 12, the fresh air inlet 15, and the gap Z.

The valve member 5 in the present embodiment can be molded by injection molding or the like using a split die of a simple configuration that splits in an arrow X direction along a parting line L illustrated in FIG. 21A and thus is excellent in productivity.

EXAMPLES

1. First Experimental Example

In the experimental example below, a delaminatable container having the outer layer 11 and the inner layer 13 was produced by blow molding, and the fresh air inlet 15 of ϕ4 mm was formed only in the outer layer 11 having a thickness of 0.7 mm using a thermal perforator. In addition, valve members 5 of first through fifth structural examples illustrated in FIGS. 16A through 20C and indicated in Table 1 were manufactured by injection molding, and the lid 5*c* of such valve member 5 was pressed into the intermediate space 21 through the fresh air inlet 15.

The valve members 5 in the first through fifth structural examples were evaluated in operability, moldability, tilt resistance, and transferability. The results are indicated in Table 1 below. The symbols X, Δ, and O in each evaluation point in Table 1 are relative evaluation results, where Δ denotes an evaluation result better than X and O denotes an evaluation result better than Δ.

TABLE 1

| | | Structural Examples | | | | |
|---|---|---|---|---|---|---|
| | | 1 | 2 | 3 | 4 | 5 |
| Lid | Diameter (mm) | 5 | 4.5 | 4.5 | 4.5 | 4.5 |
| Shape of Boundary between Lid and Axis | | Depressed Curve | Depressed Curve | Bulged Curve | Bulged Curve | Bulged Curve |
| Axis | Diameter (mm) | 3.8 | 3.8 | 3.3 | 3.5 | 3.5 |
| | Length (mm) | 0.4 | 1.4 | 1.8 | 1.8 | 1.8 |
| Locking Portion | Shape of Surface on Axis side | Four Button-Like Projections | Four Grooves | Two Grooves | Two Grooves | Two Grooves |
| | Diameter (mm) | 6 | 6 | 6 | 6 | 7 |
| | Thickness (mm) | 1 | 1 | 1 | 1 | 1.5 |
| Slidable Length (mm) | | 0 | 0.7 | 1.1 | 1.1 | 1.1 |
| Clearance to Fresh Air Inlet (mm) | | 0.2 | 0.2 | 0.7 | 0.5 | 0.5 |
| Amount of Sticking out Locking Portion (mm) | | 1 | 1.5 | 1.5 | 1.5 | 2.5 |
| Evaluation | Operability | X | Δ | O | O | O |
| | Moldability | Δ | Δ | O | O | O |
| | Tilt Resistance | X | X | Δ | O | O |
| | Transferability | Δ | Δ | Δ | Δ | O |

The operability is evaluation of whether or not the fresh air inlet 15 is smoothly opened and closed by the valve member 5. In the first structural example where the axis 5*a* has a length shorter than a thickness of the outer layer 11, a slidable length was 0 and the fresh air inlet 15 remained closed. In the second structural example, although the fresh air inlet 15 was opened and closed by the valve member 5, the operation was sometimes not smooth. In contrast, in the third through fifth structural examples, the fresh air inlet 15 was smoothly opened and closed by the valve member 5. The reasons why the valve member 5 did not operate smoothly in the second structural example may include that the slidable length (length of axis 5*a*−thickness of outer layer 11) was 0.7 mm, which was not a sufficient length, and that the clearance to the fresh air inlet 15 (diameter of fresh air inlet 15−diameter of axis 5*a*) was 0.2 mm, which was not a sufficient size. In contrast, in the third through fifth structural examples, the slidable length was 1 mm or more, which was a sufficient length, and the clearance to the fresh air inlet 15 was 0.3 mm or more, which was a sufficient size, so that the valve member 5 operated smoothly. When the slidable length exceeds 2 mm, the valve member 5 is prone to interfere with the shrink film and the inner layer 13, and thus the valve member 5 preferably has a slidable length from 1 to 2 mm.

The moldability is evaluation of ease of molding the valve member 5 by injection molding. When the surface of the locking portion 5*b* on the axis 5*a* side was provided with the projections 5*d* as in the first structural example or four grooves 5*e* circumferentially at regular intervals as in the second structural example, the valve member 5 after molding had to be forcibly taken out of the split die or a split die with a special configuration had to be prepared, so that the moldability was poor. In contrast, when two grooves 5*e* were provided circumferentially at regular intervals as in the third through fifth structural examples, the valve member 5 was readily taken out of the split die and the moldability was excellent.

The tilt resistance is evaluation of whether or not a gap is prone to be formed in the fresh air inlet 15 when the valve member 5 is tilted in a state where the lid 5*c* is pressed against the fresh air inlet 15. When the shape at a boundary 5*f* between the lid 5*c* and the axis 5*a* was a curved shape depressing inside as in the first and second structural examples, a gap was prone to be formed in the fresh air inlet 15 when the valve member 5 was tilted. In contrast, when the shape of the boundary 5*f* between the lid 5*c* and the axis 5*a* was a curved shape bulged outside as in the third through fifth structural examples, a gap was not prone to be formed in the fresh air inlet 15 when the valve member 5 was tilted.

In the third structural example, the clearance to the fresh air inlet 15 was 0.7 mm, which is too large, and the valve member 5 was tilted considerably and thus a gap was relatively prone to be formed. In contrast, in the fourth and fifth structural examples, the clearance to the fresh air inlet 15 was 0.6 mm or less, which was an adequate size, and an excessive tilt of the valve member 5 was inhibited. Considering both the operability and the tilt resistance, the clearance to the fresh air inlet 15 is preferably from 0.2 to 0.7 mm and even more preferably from 0.3 to 0.6 mm.

The transferability is evaluation of whether or not a large number of valve members 5 are readily transferred using a part feeder to hold the valve members 5 on two parallel rails at an interval slightly greater than the diameter of the lid 5*c*. The valve members 5 were inserted between the two rails with the lid 5*c* downward and held on the parallel rails by being caught on the parallel rails at the locking portion 5*b*. The transferability is further classified into anti-overlap properties and anti-fall properties.

The anti-overlap properties are evaluation of probability of not overlapping the locking portions 5*b* of the valve member 5 with each other. In the first through fourth structural examples, the locking portion 5*b* had a thickness of 1 mm, which was not a sufficient thickness, and thus the locking portions 5*b* were prone to be overlapped with each other. In contrast, in the fifth structural example, the locking portion 5*b* had a thickness of not less than 1.2 mm, which was a sufficient thickness, and the locking portions 5*b* were not prone to be overlapped with each other.

The anti-fall properties are evaluation of whether or not the valve members 5 are appropriately held on the parallel rails without being dislocated and falling out of the parallel rails. In the first through fourth structural examples, the amount of the locking portion 5*b* sticking out (diameter of locking portion 5*b*−diameter of lid 5*c*) was 1.5 mm or less, which was too small, and the valve members 5 were prone to fall out of the parallel rails. In contrast, in the fifth structural example, the amount of the locking portion 5*b* sticking out was not less than 2 mm, and the valve members 5 did not fall out of the parallel rails and readily transferred using the parallel rails.

Figure 20A:
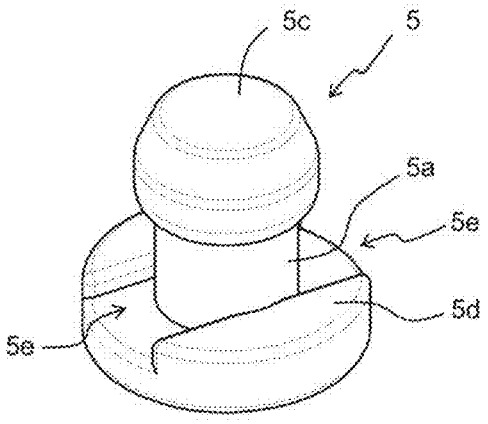
FIGS. 20A through 20C illustrate a fifth structural example of the valve member 5, where
Figure 20C:
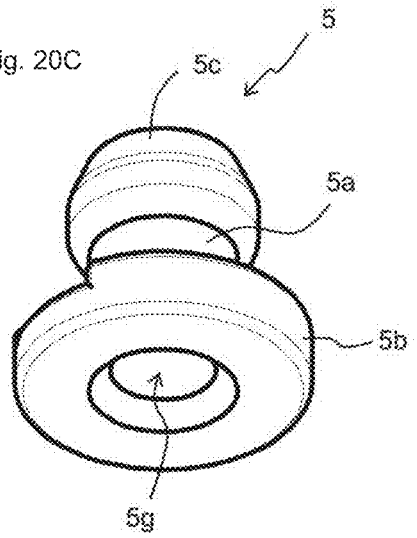
Figure 20B:
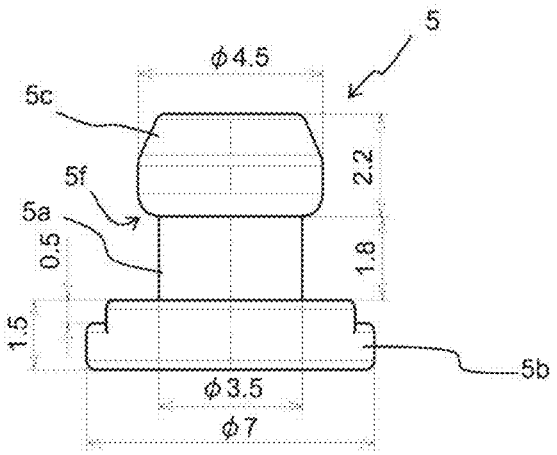

The valve member 5 in the fifth structural example, as illustrated in FIG. 20C, was equipped with a recess 5*g* in the outer surface of the locking portion 5*b*. When the valve member 5 is injection molded, burrs are formed in the position of an injection gate. By designing the position of the injection gate in the recess 5*g*, it is possible to avoid the burrs interfering with the shrink film.

2. Second Experimental Example

In the experimental example below, a delaminatable container having the outer layer 11 and the inner layer 13 was produced by blow molding and the fresh air inlet 15 was formed only in the outer layer 11 having a thickness of 0.7 mm using a thermal perforator. By variously changing an inner capacity of the delaminatable container, a size of the fresh air inlet 15, and the width W surrounding the fresh air inlet 15 in the flat region FR in the valve member mounting recess 7*a*, delaminatable containers of sample No. 1 through 5 were formed. In addition, the valve member 5 in the shape illustrated in FIGS. 20A through 20C was produced by injection molding and the lid 5*c* of the valve member 5 was pressed into the intermediate space 21 through the fresh air inlet 15. The delaminatable container 1 thus obtained was filled with the contents (water), followed by pressing a side of the delaminatable container to deliver the contents from the delaminatable container. Delivery performance when the contents at 80% of the inner capacity were delivered (delivery performance for a small amount of the contents) was evaluated. The evaluation was made as "O" for delivery of the contents with no trouble and as "X" for uneasy delivery of the contents. The results are indicated in Table 2.

TABLE 2

| | Sample No. | | | | |
|---|---|---|---|---|---|
| | 1 | 2 | 3 | 4 | 5 |
| Inner Capacity (ml) | 200 | 200 | 200 | 200 | 500 |
| Diameter of Fresh Air Inlet | 4.0 | 3.8 | 3.7 | 3.7 | 4.0 |
| Width W of Flat Region FR | 2.0 | 2.1 | 2.2 | 4.2 | 4.0 |
| Delivery Performance For Small Amount of Contents | X | X | X | ○ | ○ |
| Radius of Curvature on Outer Shell Inner Surface (mm) | 30 | 30 | 30 | 300 | 750 |

As indicated in Table 2, samples No. 1 through 3 had low delivery performance for a small amount of the contents and samples No. 4 through 5 had high delivery performance for a small amount of the contents. To review reasons of such results, each sample was measured on a radius of curvature on the inner surface of the outer shell 12 in a range of 2 mm surrounding the fresh air inlet 15, and the results indicated in Table 2 were obtained. As indicated in Table 2, when the width W of the flat region FR on the outer surface of the outer shell 12 was 3 mm or more, it was found that the radius of curvature on the inner surface of the outer shell 12 became severely large and the inner surface of the outer shell 12 became approximately flat. In contrast, when the width W of the flat region FR on the outer surface of the outer shell 12 was less than 3 mm, it was found that the inner surface of the outer shell 12 did not become flat but curved. Then, it was found that the delivery performance for a small amount of the contents was lowered by air leakage from the fresh air inlet 15 because of the curved surface did not appropriately match the valve member 5.

3. Third Experimental Example

In the experimental example below, various delaminatable containers having different layer structures were produced by blow molding for various types of evaluation, such as restorability, rigidity, impact resistance, heat resistance, transparency, gas barrier properties, moldability, and outer layer processability. The outer layer processability indicates ease of process of forming the fresh air inlet 15 only in the outer layer 11 using a thermal perforator.

First Structural Example

In the first structural example, the layer structure was, in order from outside the container, random copolymer layer/EVOH layer/adhesion layer/LLDPE layer. For the random copolymer layer, a random copolymer of propylene and ethylene (model: NOVATEC EG7FTB, produced by Japan Polypropylene Corp., melting point of 150° C.) was used. For the EVOH layer, EVOH having a high melting point (model: Soarnol SF7503B, produced by Nippon Synthetic Chemical Industry Co., Ltd., melting point of 188° C., modulus of elasticity in bending of 2190 MPa) was used. According to the above various types of evaluation, excellent results were obtained in all evaluation categories.

Second Structural Example

In the second structural example, the layer structure was, in order from outside the container, random copolymer layer/reproduction layer/random copolymer layer/EVOH layer/adhesion layer/LLDPE layer. The reproduction layer is made from a material obtained by recycling burrs produced while molding a container and has composition very close to that of the random copolymer layer. The random copolymer layer and the EVOH layer were formed of materials same as those in the first structural example. According to the above various types of evaluation, excellent results were obtained in all evaluation categories.

Third Structural Example

In the third structural example, the layer structure was same as that in the first structural example while, for the EVOH layer, EVOH having a low melting point (model: Soarnol A4412, produced by Nippon Synthetic Chemical Industry Co., Ltd., melting point of 164° C.) was used. According to the above various types of evaluation, excellent results were obtained in all evaluation categories other than the outer layer processability. The outer layer processability was slightly worse than that in the first structural example. This result demonstrates that the difference of (melting point of EVOH)−(melting point of random copolymer layer) is preferably 15° C. or more.

First Comparative Structural Example

In the first comparative structural example, the layer structure was, in order from outside the container, LDPE layer/EVOH layer/adhesion layer/LLDPE layer. According to the above various types of evaluation, at least the rigidity and the heat resistance were low.

Second Comparative Structural Example

In the second comparative structural example, the layer structure was, in order from outside the container, HDPE layer/EVOH layer/adhesion layer/LLDPE layer. According to the above various types of evaluation, at least the restorability and the transparency were low.

Third Comparative Structural Example

In the third comparative structural example, the layer structure was, in order from outside the container, polypropylene layer/EVOH layer/adhesion layer/LLDPE layer. For the material for the polypropylene layer, a homopolymer of propylene having a melting point of 160° C. was used. For the EVOH layer, the material same as that in the first structural example was used. According to the above various types of evaluation, at least the impact resistance was low. In addition, the outer layer processability was worse than that in the first structural example.

Fourth Comparative Structural Example

In the fourth comparative structural example, the layer structure was, in order from outside the container, block copolymer layer/EVOH layer/adhesion layer/LLDPE layer. According to the above various types of evaluation, at least the transparency and the impact resistance were low.

Fifth Comparative Structural Example

In the fifth comparative structural example, the layer structure was, in order from outside the container, PET layer/EVOH layer/adhesion layer/LLDPE layer. According to the above various types of evaluation, at least the moldability and the heat resistance were low.

Sixth Comparative Structural Example

In the sixth comparative structural example, the layer structure was, in order from outside the container, polyamide layer/EVOH layer/adhesion layer/LLDPE layer. According to the above various types of evaluation, at least the moldability was low.

Seventh Comparative Structural Example

In the sixth comparative structural example, the layer structure was, in order from outside the container, polypropylene layer/polyamide layer/adhesion layer/LLDPE layer. According to the above various types of evaluation, at least the gas barrier properties and the moldability were low.

<Bend Test>

For an EVOH resin used as the EVOH layer, a bend test was performed using a Gelbo Flex Tester in accordance with ASTM F392 (manufactured by Brugger, KFT-C—Flex Durability Tester). The test environment was at 23° C. and 50% RH.

Firstly, a sample made from a single layer film in 28 cm×19 cm×30 μm was prepared.

Then, a longer side of the sample was wound around a pair of mandrels (diameter of 90 mm) arranged at an interval of 180 mm for fixation of both ends of the sample to the pair of mandrels A and B.

Then, while the mandrel A remained fixed, the mandrel B was gradually brought closer while being twisted and the twist was stopped when the twisting angle was 440 degrees and the horizontal movement distance reached 9.98 cm. After that, the horizontal movement of the mandrel B was continued and the horizontal movement was stopped when the horizontal movement distance after stopping twisting reached 6.35 cm. After that, the mandrel B was returned to the initial state by an operation opposite to above. Such operation was performed 100 times, followed by check on the presence of a pinhole. The results are indicated in Table 3.

TABLE 3

| | Number of Pinholes (number) | | |
|---|---|---|---|
| | n = 1 | n = 2 | Average |
| SF7503B | 0 | 0 | 0 |
| D2908 | 122 | 118 | 120 |

SF7503B in Table 3 is an EVOH resin used for the EVOH layer in the first structural example. Meanwhile, D2908 in Table 3 is Soarnol D2908 (model: Soarnol SF7503B, produced by Nippon Synthetic Chemical Industry Co., Ltd.), which is a general EVOH resin. Each EVOH resin was subjected to the test twice.

As indicated in Table 3, by the test above, many pinholes were created in D2908, whereas no pinhole was created at all in SF7503B and it was found that the latter was excellent in bending resistance more than a general EVOH resin.

4. Fourth Experimental Example

In the experimental example below, various delaminatable containers having different layer structures were produced by blow molding and such container thus obtained was filled with citrus flavored soy sauce, followed by still standing for one week, and then the total amount of citrus flavored soy sauce in the container was delivered for sensory evaluation of the citrus aroma in the delivered citrus flavored soy sauce. In addition, the shape of the inner bag of the container when the citrus flavored soy sauce is delivered was visually evaluated.

First Structural Example

In the first structural example, the layer structure was, in order from outside the container, random copolymer layer/external EVOH layer (thickness of 25 μm)/adhesion layer (thickness of 150 μm)/internal EVOH layer (thickness of 15 μm). The external EVOH layer was formed of an EVOH resin added to a softening agent and the internal EVOH layer was formed of an EVOH resin not added to a softening agent. The adhesion layer was formed of a mixture of linear low density polyethylene and acid modified polyethylene at a mass ratio of 50:50. According to the above evaluation, intensity of the citrus aroma emitted by the delivered citrus flavored soy sauce was barely different. In addition, when the inner bag shrunk with the delivery of the citrus flavored soy sauce, the inner bag shrunk smoothly without being folded.

Second Structural Example

In the second structural example, the layer structure was same as that in the first structural example other than changing the thickness of the internal EVOH layer to 5 μm. According to the above evaluation, the intensity of the citrus aroma emitted by the delivered citrus flavored soy sauce was slightly worse than that in the first structural example. In addition, when the inner bag shrunk with the delivery of the citrus flavored soy sauce, the inner bag shrunk smoothly without being folded.

Third Structural Example

In the third structural example, the layer structure was same as that in the first structural example other than changing the thickness of the internal EVOH layer to 25 μm. According to the above evaluation, the intensity of the citrus aroma emitted by the delivered citrus flavored soy sauce was at an equivalent level to that in the first structural example. In addition, when the inner bag shrunk with the delivery of the citrus flavored soy sauce, the inner bag was prone to be folded than in the first structural example.

Fourth Structural Example

In the fourth structural example, the layer structure was same as that in the first structural example other than changing the thickness of the external EVOH layer to 75 μm and the thickness of the adhesion layer to 80 μm. According to the above evaluation, the intensity of the citrus aroma emitted by the delivered citrus flavored soy sauce was at an equivalent level to that in the first structural example. In addition, when the inner bag shrunk with the delivery of the citrus flavored soy sauce, the inner bag was prone to be folded than in the first structural example.

First Comparative Structural Example

In the first comparative structural example, the layer structure was same as that in the first structural example other than replacing the internal EVOH layer by a linear low density polyethylene layer (50 μm). According to the above evaluation, the intensity of the citrus aroma emitted by the delivered citrus flavored soy sauce was significantly worse than that in the first structural example. In addition, when the inner bag shrunk with the delivery of the citrus flavored soy sauce, the inner bag shrunk smoothly without being folded.

Second Comparative Structural Example

In the second comparative structural example, the layer structure was same as that in the first structural example other than replacing the internal EVOH layer by a polyamide layer (50 μm). According to the above evaluation, the intensity of the citrus aroma emitted by the delivered citrus flavored soy sauce was significantly worse than that in the first structural example. In addition, when the inner bag shrunk with the delivery of the citrus flavored soy sauce, the inner bag shrunk smoothly without being folded.

REFERENCE SIGNS LIST

1: Delaminatable Container, 3: Container Body, 5: Valve Member, 7: Storage Portion, 9: Mouth, 11: Outer Layer, 12: Outer Shell, 13: Inner Layer, 14: Inner Bag, 15: Fresh Air Inlet, 23: Cap, 27: Bottom Seal Protrusion

The invention claimed is:

1. A delaminatable container, comprising:

a container body having an outer shell and an inner bag, the inner bag being configured to be shrunk with a decrease in contents, wherein the container body is provided with a storage portion to store contents and a mouth to deliver the contents from the storage portion, a recess which is concave toward an inside of the storage portion is provided in a main portion or a shoulder portion of the storage portion, the outer shell is provided with a fresh air inlet communicating with an intermediate space and an external space in the recess, the number of the fresh air inlet in the recess is one, and an air circulation groove extending from the recess toward the mouth is provided along an outer surface of the container body.

2. The container of claim 1, wherein the recess is provided in a shoulder portion of the storage portion.

3. The container of claim 1, wherein the recess includes a flat region with a width of 3 mm or more around the fresh air inlet.

4. The container of claim 1, further comprising a valve member to regulate entrance and exit of air between the external space of the container body and the intermediate space between the outer shell and the inner bag, wherein the valve member is mounted to the fresh air inlet.

5. The container of claim 4, wherein the valve member includes an axis inserted into the fresh air inlet, a lid provided on a side of the intermediate space in the axis and having a cross-sectional area greater than that of the axis, and a locking portion provided on a side of the external space in the axis and preventing entrance of the valve member to the intermediate space.

6. The container of claim 5, wherein the valve member is configured to be mounted to the container body by pressing the lid from outside of the container body into the intermediate space via the fresh air inlet.

7. The container of claim 5, wherein the valve member is mounted to the container body in such a way that the lid expands the fresh air inlet.

8. The container of claim 5, wherein the locking portion has a groove on a side of the outer shell.

9. The container of claim 5, wherein the locking portion has a projection which is capable of contacting the outer shell.

10. The container of claim 5, wherein the lid is pressed against the outer shell by a biasing force produced by the locking portion.

11. The container of claim 5, wherein the locking portion includes a pair of foundation portions and a bridge portion provided between the foundation portions, and the axis is provided in the bridge portion.

12. The container of claim 4, wherein the storage portion is covered with a shrink film after the valve member is mounted.

13. The container of claim 4, wherein the valve member has an end in a tapered shape.

14. The container of claim 1, wherein the fresh air inlet is provided on an inclined surface.

* * * * *